US012359667B2

(12) United States Patent
Tanimoto et al.

(10) Patent No.: US 12,359,667 B2
(45) Date of Patent: Jul. 15, 2025

(54) SCREW COMPRESSOR

(71) Applicant: HITACHI INDUSTRIAL EQUIPMENT SYSTEMS CO., LTD., Tokyo (JP)

(72) Inventors: Shota Tanimoto, Tokyo (JP); Kohei Sakai, Tokyo (JP); Toshiaki Yabe, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 18/697,026

(22) PCT Filed: Sep. 30, 2022

(86) PCT No.: PCT/JP2022/036621
§ 371 (c)(1),
(2) Date: Mar. 29, 2024

(87) PCT Pub. No.: WO2023/084938
PCT Pub. Date: May 19, 2023

(65) Prior Publication Data

US 2025/0035115 A1 Jan. 30, 2025

(30) Foreign Application Priority Data

Nov. 9, 2021 (JP) ..... 2021-182696

(51) Int. Cl.
*F04C 29/04* (2006.01)
*F04C 18/16* (2006.01)

(52) U.S. Cl.
CPC ..... *F04C 29/04* (2013.01); *F04C 18/16* (2013.01); *F04C 2240/603* (2013.01)

(58) Field of Classification Search
CPC .. F04C 18/16; F04C 2/16; F04C 29/04; F04C 29/042; F04C 15/0096; F04C 2240/603
See application file for complete search history.

(56) References Cited

U.S. PATENT DOCUMENTS 2,410,172 A * 10/1946 Lysholm ..... F04C 18/16 418/91
2,938,664 A * 5/1960 Noller ..... F04C 29/04 418/94

(Continued)

FOREIGN PATENT DOCUMENTS

JP 51-31911 A 3/1976
JP 57-70985 A 5/1982

(Continued)

OTHER PUBLICATIONS

International Search Report of PCT/JP2022/036621 dated Nov. 8, 2022.

(Continued)

*Primary Examiner* — Mark A Laurenzi
*Assistant Examiner* — Xiaoting Hu
(74) *Attorney, Agent, or Firm* — MATTINGLY & MALUR, PC

(57) ABSTRACT

A male rotor of a screw compressor has a cooling flow path extending in an axial direction inside a discharge-side shaft section. A groove structure is provided at at least a part of a region on a wall surface of the cooling flow path between the position of a discharge-side end face of the male rotor and a mounting position of a discharge-side bearing. The groove structure includes grooves or a groove that has a lengthwise component in a circumferential direction of the screw rotor and that are spaced apart in the axial direction. A nozzle which is a stationary member is arranged inside the cooling flow path with a gap between the nozzle and the wall surface (Continued)

of the cooling flow path. The nozzle is arranged in such a manner as to overlap at least a part of the groove structure in the axial direction.

8 Claims, 11 Drawing Sheets

(56) References Cited

U.S. PATENT DOCUMENTS

| | | | | |
|---|---|---|---|---|
| 4,073,607 | A | 2/1978 | Webb et al. | |
| 5,468,131 | A * | 11/1995 | Blume | F04C 15/0096 418/94 |
| 6,382,930 | B1 * | 5/2002 | Bahnen | F04C 28/26 417/310 |
| 9,624,927 | B2 * | 4/2017 | Bahnen | F04C 18/16 |
| 2008/0031761 | A1 * | 2/2008 | North | F04C 18/16 418/83 |
| 2010/0054980 | A1 | 3/2010 | Moens | |

FOREIGN PATENT DOCUMENTS

| | | | |
|---|---|---|---|
| JP | 7-259752 | A | 10/1995 |
| JP | 2006-097604 | A | 4/2006 |
| JP | 2010-510432 | A | 4/2010 |
| JP | 2017-110517 | A | 6/2017 |

OTHER PUBLICATIONS

International Preliminary Report on Patentability received in corresponding International Application No. PCT/JP2022/036621 dated May 23, 2024.

* cited by examiner

COMPARATIVE EXAMPLE

COMPARATIVE EXAMPLE

SCREW COMPRESSOR

TECHNICAL FIELD

The present invention relates to a screw compressor, and more specifically, relates to a screw compressor that cools a screw rotor by using a coolant.

BACKGROUND ART

Screw compressors include screw rotors that rotate and a casing that houses the screw rotors. Screw compressors suck in and compress a gas by causing the volumes of a plurality of working chambers defined by screw rotors and the inner wall surface of a casing surrounding the screw rotors to increase and decrease along with rotation of the screw rotors.

A representative one of causes of deterioration of the performance of screw compressors is an internal leak of a compressed gas. An internal leak of a compressed gas is a phenomenon in which the compressed gas flows backward undesirably from a high-pressure space (working chamber) with an increased pressure where the compression has progressed, to a space with a relatively low pressure where the compression has not yet started or has not progressed. The internal leak causes energy loss since the gas for which energy has been consumed for compression returns to a low-pressure state undesirably. Inner gaps that serve as the paths for internal leaks of a compressed gas include a gap between meshing portions of screw rotors, a gap between lobe tips of a screw rotor and the inner wall surface (inner circumferential surface) of a casing, a gap between the discharge-side end face of a screw rotor and the discharge-side inner wall surface of the casing facing the discharge-side end face (hereinafter, referred to as a discharge-side end face gap in some cases), and the like.

Since a compressed gas has a high temperature in a screw compressor, the casing and the screw rotors increase in temperature, resulting in thermal deformation. Due to the thermal deformation of the casing and the screw rotors, the inner gaps mentioned above tend to enlarge.

As a measure to reduce thermal deformation of a screw rotor, there are known methods in which the screw rotor is cooled by supplying a coolant to a cooling flow path (hole) provided inside the screw rotor. As an example of such screw-rotor cooling methods, there is a technology described in Patent Document 1, for example. In a rotor of a compressor element described in Patent Document 1, an inner cooling channel extending in the axial direction at the center of the rotor is provided with inwardly directed fins.

PRIOR ART DOCUMENT

Patent Document

Patent Document 1: JP-2010-510432-A

SUMMARY OF THE INVENTION

Problem to be Solved by the Invention

In order to attempt to improve the compressor efficiency, it is necessary to suppress enlargement of the inner gaps mentioned above by further improving the capability to cool a screw rotor. It has become clear that the discharge-side end face gap mentioned above enlarges due to thermal deformation of a screw rotor in the axial direction. Therefore, it is required to reduce the thermal deformation of the screw rotor that enlarges the discharge-side end face gap. In particular, it is expected that thermal deformation of a discharge-side shaft section of the screw rotor has a significant influence on the enlargement of the discharge-side end face gap.

One possible example of methods of improving the capability to cool a screw rotor is to lower the temperature of a coolant to be supplied to a cooling flow path of the screw rotor. However, this method requires a size increase of a cooler for cooling the coolant, and undesirably increases the cost. Further, in a case where the cooler is an air-cooling type cooler that cools the coolant by using outside air, the temperature of the coolant is undesirably restricted to a temperature equal to or higher than the temperature of the outside air.

Another possible example of the methods of improving the cooling capability is to increase the flow rate of a coolant to be supplied to a cooling flow path. However, this method requires a size increase of a pump for supplying the coolant, and, as a result, undesirably increases the overall motive power of a compressor system.

Accordingly, it is required to enhance the capability to cool a screw rotor without varying the temperature or flow rate of a coolant to be supplied to a cooling flow path.

In addition, it is considered that, according to the technology described in Patent Document 1, the presence of the multiple fins in the cooling channel increases the surface area of heat exchange with a coolant flowing through the cooling channel, and accordingly, the capability to cool the screw rotor is improved. However, the configuration in which the inwardly directed fins are provided in the cooling channel of the screw rotor complicates the structure.

The present invention has been made to solve the problems described above, and one of objects thereof is to provide a screw compressor that can enhance the capability to cool a discharge-side shaft section of a screw rotor, by using a simple structure.

Means for Solving the Problem

A preferable example of the present invention is a screw compressor including a screw rotor and a discharge-side bearing, the screw rotor including a rotor lobe section that has a twisted lobe and also has a discharge-side end face on one side in an axial direction, and a discharge-side shaft section provided on the one side in the axial direction at the rotor lobe section, and the discharge-side bearing being mounted on the discharge-side shaft section. The screw rotor has a cooling flow path extending in the axial direction at least inside the discharge-side shaft section. A groove structure is provided at at least a part of a region on a wall surface of the cooling flow path between a position of the discharge-side end face in the axial direction and a mounting position of the discharge-side bearing. The groove structure includes grooves or a groove that has a lengthwise component in a circumferential direction of the screw rotor and that are spaced apart in the axial direction. A nozzle that is a stationary member for supplying a coolant is arranged inside the cooling flow path with a gap between the nozzle and the wall surface. The nozzle is arranged in such a manner as to overlap at least a part of the groove structure in the axial direction.

Advantages of the Invention

According to the preferable example of the present invention, a relative speed of the coolant, which flows through a region near a wall surface positioned between the groove(s) of the groove structure in the cooling flow path, relative to the wall surface increases due to an influence of the coolant flowing through regions at groove positions adjacent in the axial direction. In addition, a relative speed of the coolant, which flows on the side of the wall surface of the cooling flow path, relative to the wall surface increases due to an influence of the coolant flowing near the nozzle. These enhance the heat transfer coefficient on the wall surface of the cooling flow path having the groove structure, thereby improving the capability to cool the discharge-side shaft section of the screw rotor. That is, the capability to cool the discharge-side shaft section of the screw rotor can be enhanced with a simple structure.

Problems, configurations, and advantages other than those described above are made clear by the following explanation of embodiments.

MODES FOR CARRYING OUT THE INVENTION

Hereinbelow, embodiments of a screw compressor according to the present invention are illustratively explained by using the figures. The embodiments explained here depict examples in which the present invention is applied to an oil-free screw compressor.

First Embodiment

Figure 1:
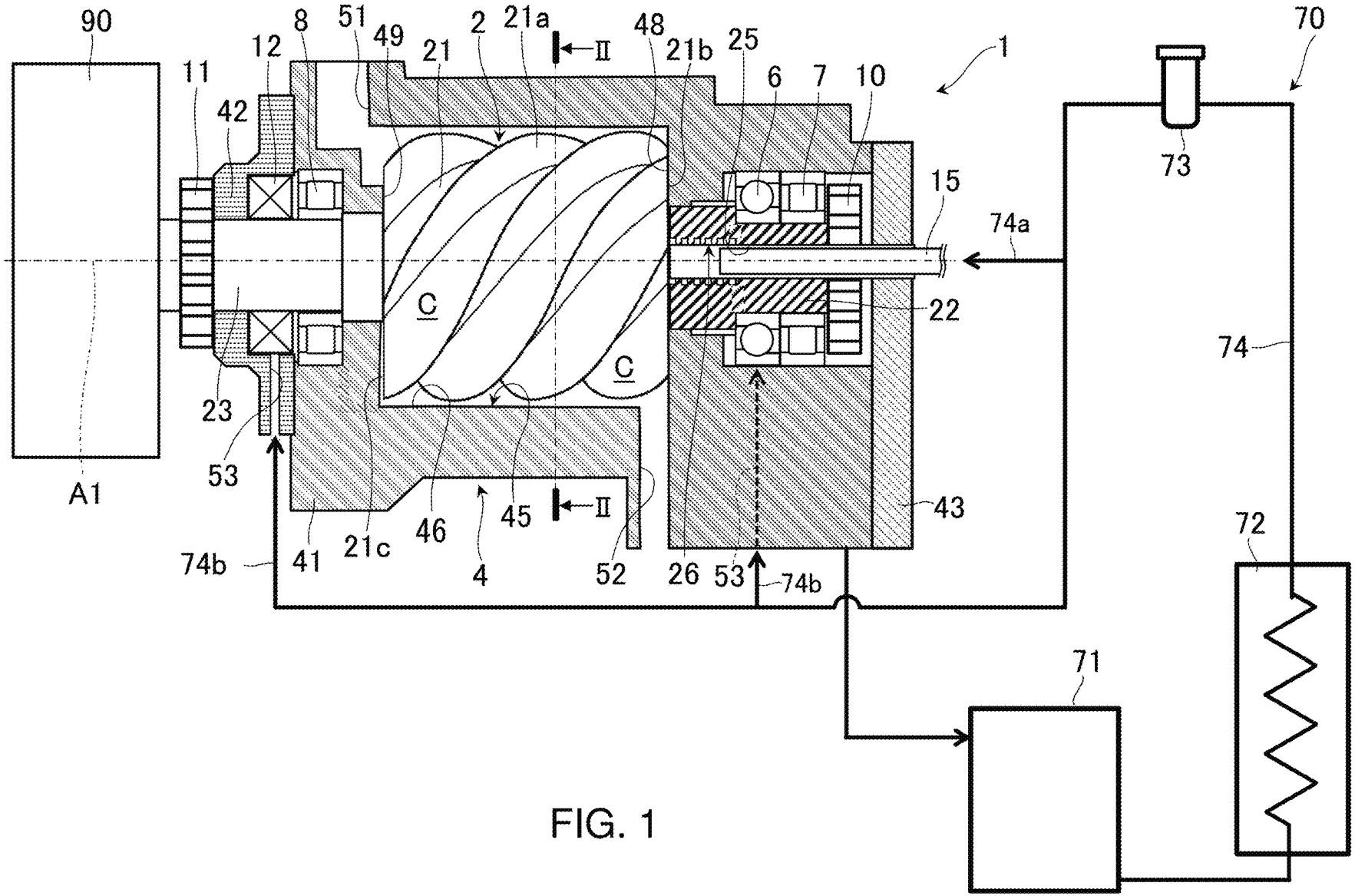
FIG. 1 represents a cross-sectional view depicting the schematic structure of a screw compressor according to a first embodiment of the present invention, and a system diagram depicting an external supply path of a coolant for the screw compressor.
Figure 2:
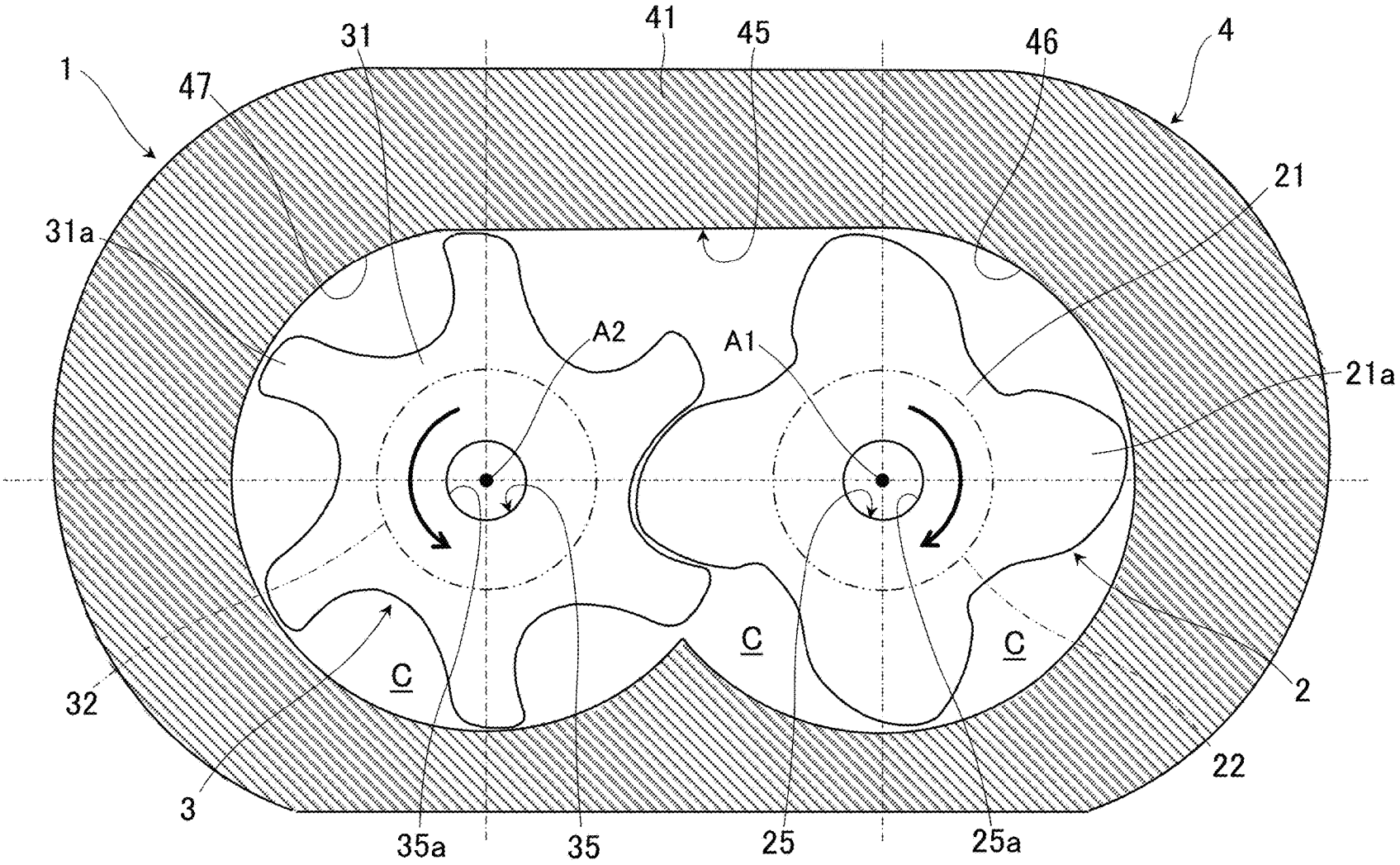
FIG. 2 is a cross-sectional view of the screw compressor according to the first embodiment taken along a line II-II depicted in FIG. 1.

The configuration of a screw compressor according to a first embodiment is explained by using FIG. 1 and FIG. 2. FIG. 1 represents a cross-sectional view depicting the schematic structure of the screw compressor according to the first embodiment of the present invention, and a system diagram depicting an external supply path of a coolant for the screw compressor. FIG. 2 is a cross-sectional view of the screw compressor according to the first embodiment taken along a line II-II depicted in FIG. 1. In FIG. 1, the left side is a suction side of the screw compressor in its axial direction, and the right side is a discharge-side of the screw compressor in its axial direction. In FIG. 2, bold-line arrows represent rotation directions of screw rotors.

In FIG. 1 and FIG. 2, a screw compressor 1 includes a male rotor 2 (a male-type screw rotor) and a female rotor 3 (a female-type screw rotor) that rotate while meshing with each other, and a casing 4 that houses both of the male and female rotors 2 and 3 in a meshing state in a rotatable manner. The male rotor 2 and the female rotor 3 are arranged such that their central axis lines A1 and A2 are parallel to each other. On its one side (the right side in FIG. 1) and another side (the left side in FIG. 1) in its axial direction (the left-right direction in FIG. 1), the male rotor 2 is rotatably supported by discharge-side bearings 6 and 7 and a suction-side bearing 8, respectively, and is connected to a motor 90 which is a rotation drive source, for example. For example, the discharge-side bearing 6 is a bearing for positioning the male rotor 2 in the axial direction. On its one side and another side in its axial direction, the female rotor 3 is rotatably supported by discharge-side bearings and a suction-side bearing (both of which are not depicted), respectively. In the oil-free screw compressor 1, the male rotor 2 and the female rotor 3 are arranged such that they rotate in a contactless state.

The male rotor 2 includes a rotor lobe section 21 having a plurality of helical, twisted male lobes 21*a* (four male lobes 21*a* in FIG. 2), and a discharge-side shaft section 22 provided on one side (the right side in FIG. 1) in the axial direction and a suction-side shaft section 23 provided on the other side (the left side in FIG. 1) in the axial direction at the rotor lobe section 21. The male rotor 2 is configured as one member having the rotor lobe section 21, the discharge-side shaft section 22, and the suction-side shaft section 23 that are formed integrally (see FIG. 3 mentioned later). The rotor lobe section 21 has a discharge-side end face 21*b* and a suction-side end face 21*c* that are orthogonal to the axial direction (the central axis line A1) at one end (the right end in FIG. 1) and the other end (the left end in FIG. 1) in the axial direction, respectively. At the rotor lobe section 21, the male lobes 21*a* extend from the discharge-side end face 21*b* to the suction-side end face 21*c*, and grooves are formed between the male lobes 21*a*. A timing gear 10 is mounted at a distal end portion of the discharge-side shaft section 22. For example, the suction-side shaft section 23 extends out of the casing 4 and is connected with the motor 90 via a gear 11. Note that a configuration in which the suction-side shaft section 23 is directly connected with the motor 90 without using the gear 11 is also possible.

The female rotor 3 includes a rotor lobe section 31 having a plurality of helical, twisted female lobes 31*a* (six female lobes 31*a* in FIG. 2), and a discharge-side shaft section 32 provided on one side in the axial direction and a suction-side shaft section (not depicted) provided on the other side in the axial direction (a direction orthogonal to the paper surface of FIG. 2) at the rotor lobe section 31. For example, similarly to the male rotor 2, the female rotor 3 also is configured as one member having the rotor lobe section 31, the discharge-side shaft section 32, and the suction-side shaft section that are formed integrally. The rotor lobe section 31 has a discharge-side end face and a suction-side end face (both of which are not depicted) perpendicular to the axial direction (the central axis line A2) at one end and the other end in the axial direction, respectively. At the rotor lobe section 31, the female lobes 31*a* extend from the suction-side end face to the discharge-side end face, and grooves are formed between the female lobes 31*a*. A timing gear (not depicted) that meshes with the timing gear 10 on the side of the male rotor 2 is mounted at a distal end portion of the discharge-side shaft section 32. Due to the timing gear 10 on the side of the male rotor 2 and the timing gear on the side of the female rotor 3, a rotational force of the male rotor 2 is transferred to the female rotor 3, and the male rotor 2 and the female rotor 3 rotate synchronously in a contactless manner.

The casing 4 includes a main casing 41, a suction-side cover 42 mounted on the suction side (the left side in FIG. 1) of the main casing 41, and a discharge-side cover 43 mounted on the discharge-side (the right side in FIG. 1) of the main casing 41.

The casing 4A has a housing chamber 45 that houses the rotor lobe section 21 of the male rotor 2 and the rotor lobe section 31 of the female rotor 3 in a mutually meshing state. The housing chamber 45 has two partially-overlapping cylindrical spaces formed inside the casing 4. The wall surface defining the housing chamber 45 (the inner wall surface of the casing 4) includes a substantially cylindrical male-side inner circumferential surface 46 covering the radially outer side of the rotor lobe section 21 of the male rotor 2, a substantially cylindrical female-side inner circumferential surface 47 covering the radially outer side of the rotor lobe section 31 of the female rotor 3, a discharge-side inner wall surface 48 on one side (the right side in FIG. 1) in the axial direction facing the discharge-side end faces 21*b* of the rotor lobe sections 21 and 31 of the male and female rotors 2 and 3, and a suction-side inner wall surface 49 on the other side (the left side in FIG. 1) in the axial direction facing the suction-side end faces 21*c* of the rotor lobe sections 21 and 31 of the male and female rotors 2 and 3. The rotor lobe sections 21 and 31 of the male and female rotors 2 and 3 are arranged with a gap of several dozen to several hundred micrometers between the rotor lobe sections 21 and 31 and the inner wall surface of the casing 4. The rotor lobe sections 21 and 31 of the male and female rotors 2 and 3 and the inner wall surface of the casing 4 surrounding the rotor lobe sections 21 and 31 form a plurality of working chambers C. A working gas in the working chambers C is compressed by the working chambers C contracting while moving in the axial direction along with the rotation of the male and female rotors 2 and 3.

As depicted in FIG. 1, the casing 4 is provided with a suction flow path 51 for sucking the gas into the working chambers C, in such a manner that the suction flow path 51 communicates with the other side (the left side in FIG. 1) in the axial direction at the housing chamber 45. In addition, the casing 4 is provided with a discharge flow path 52 for guiding and discharging compressed air in the working chambers C to the outside of the casing 4, in such a manner that the discharge flow path 52 communicates with one side (the right side in FIG. 1) in the axial direction at the housing chamber 45.

The suction-side bearing 8 on the side of the male rotor 2 and the suction-side bearing on the side of the female rotor 3 are arranged at an end of the main casing 41 on the side of the suction flow path 51. In addition, a shaft seal member 12 is arranged, on a portion closer to the motor 90 with respect to the suction-side bearing 8, on the suction-side shaft section 23 of the male rotor 2. The suction-side cover 42 is mounted on the main casing 41 in such a manner as to cover the suction-side bearing 8 and the shaft seal member 12. The suction-side cover 42 is provided with an oil supply path 53 for supplying a lubricant to the suction-side bearing 8 and the shaft seal member 12.

The discharge-side bearings 6 and 7 and the timing gear 10 on the side of the male rotor 2 and the discharge-side bearings and the timing gear on the side of the female rotor 3 are arranged at an end of the main casing 41 on the side of the discharge flow path 52. The main casing 41 is provided with the oil supply path 53 for supplying a lubricant to the discharge-side bearings 6 and 7 and the timing gear 10. The discharge-side cover 43 is mounted on the main casing 41 in such a manner as to cover the discharge-side bearings 6 and 7 and the timing gear 10.

As depicted in FIG. 1 and FIG. 2, the male rotor 2 (male-type screw rotor) and the female rotor 3 (female-type screw rotor) according to the present embodiment are provided with a cooling flow path 25 and a cooling flow path 35 for allowing a coolant to circulate therethrough. The cooling flow path 25 and the cooling flow path 35 are paths for distributing the coolant for cooling the male rotor 2 and the female rotor 3 to which heat generated by compression of the gas is transferred. The screw compressor 1 according to the present embodiment has a feature in the structure of the cooling flow path 25 of the male rotor 2. Details of the structure of the cooling flow path 25 are mentioned later.

As depicted in FIG. 1, the cooling flow paths 25 and 35 of both of the male and female rotors 2 and 3 (screw rotors) are connected with an external cooling system 70 for circulating the coolant. For example, the external cooling system 70 is configured to use a lubricant for lubricating the discharge-side bearings 6 and 7 and the suction-side bearing 8 for the male and female rotors 2 and 3 as the coolant for cooling the male and female rotors 2 and 3. Specifically, the external cooling system 70 includes a pump 71 that feeds the lubricant (coolant) to the discharge-side bearings 6 and 7, the suction-side bearing 8, and the cooling flow paths 25 and 35 of the male and female rotors 2 and 3, a cooler 72 that cools the lubricant (coolant), an auxiliary element 73 such as a filter or a check valve, and a pipe 74 connecting them. For example, the cooler 72 is an air-cooling type cooler that cools the lubricant by using outside air around the cooler 72. The pipe 74 includes a coolant supply line 74*a* for supplying the lubricant as the coolant to the cooling flow paths 25 and 35, and a lubricant supply line 74*b* for supplying the lubricant to the discharge-side bearings 6 and 7 and the suction-side bearing 8. In FIG. 1, bold-line arrows represent directions of the flow of the lubricant (coolant).

Note that, in an example depicted in the present embodiment, by using the lubricant as the coolant for the male and female rotors 2 and 3, the external cooling system that supplies the coolant to the cooling flow paths 25 and 35 of the male and female rotors 2 and 3 and a lubrication system that supplies the lubricant to the discharge-side bearings 6 and 7 and the suction-side bearing 8 are configured integrally. However, it is possible to use, as the coolant, a liquid such as cooling water or a gas, other than the lubricant. In this case, the external cooling system is configured as a system separate from the lubrication system. For example, it is possible to configure the external cooling system to introduce the coolant such as cooling water to both of the male and female rotors 2 and 3 and the motor 90.

Figure 3:
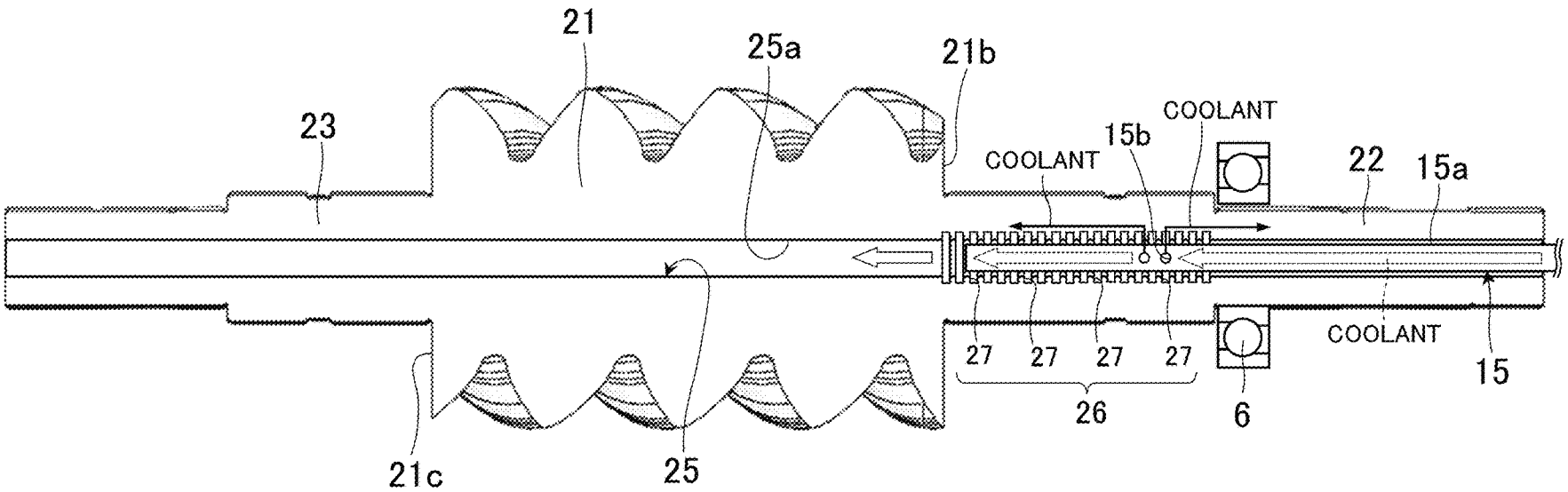
FIG. 3 is a cross-sectional view depicting the structure of a cooling flow path and the arrangement of a nozzle of a screw rotor (male rotor) in the screw compressor according to the first embodiment depicted in FIG. 1.

Next, the configuration and structure of the cooling flow path of the screw rotor (male rotor) in the screw compressor according to the first embodiment are explained by using FIG. 1 to FIG. 3. FIG. 3 is a cross-sectional view depicting the structure of the cooling flow path and the arrangement of a nozzle of the screw rotor (male rotor) in the screw compressor according to the first embodiment depicted in FIG. 1.

In the screw compressor 1 having the configuration mentioned above, when the motor 90 depicted in FIG. 1 rotationally drives the male rotor 2, the male rotor 2 rotationally drives the female rotor 3 depicted in FIG. 2 via the timing gear 10. The working chambers C depicted in FIG. 1 and FIG. 2 thus move in the axial direction along with the rotation of the male and female rotors 2 and 3. At this time, the volumes of the working chambers C are increased to thereby suck in a gas (e.g., air) from the outside of the casing 4 via the suction flow path 51 depicted in FIG. 1, and then the volumes of the working chambers C are decreased to thereby compress the gas to a predetermined pressure. When the working chambers C communicate with the discharge flow path 52, the compressed gas in the working chambers C passes through the discharge flow path 52 to be discharged to the outside of the casing 4.

Temperatures of regions around the discharge flow path 52 in the male and female rotors 2 and 3 and a region on the discharge-side in the axial direction in the housing chamber 45 of the casing 4 increase since heat generated in the compression process of the gas is transferred to those regions. The heat transfer causes thermal deformation of the male and female rotors 2 and 3. In particular, thermal deformation of the discharge-side shaft sections 22 and 32 of the male and female rotors 2 and 3 positioned near the discharge flow path 52 where the high-temperature compressed gas flows becomes significant. The thermal deformation causes a relative distance from the mounting position of the discharge-side bearing 6 to the position of the discharge-side end face 21*b* at the male rotor 2 and a relative distance from the mounting position of the discharge-side bearing to the position of the discharge-side end face at the female rotor 3 to enlarge in some cases. If the enlargement of the relative distances causes a discharge-side end face gap which is a gap between the discharge-side end faces 21*b* of the male and female rotors 2 and 3 and the discharge-side inner wall surface 48 of the casing 4 facing the discharge-side end faces 21*b* to enlarge, an internal leak of the compressed gas via the discharge-side end face gap increases undesirably.

The screw compressor 1 according to the present embodiment includes a cooling system to cool both of the male and female rotors 2 and 3. For example, as depicted in FIG. 2 and FIG. 3, the male rotor 2 has the cooling flow path 25 extending in the axial direction along the central axis line A1. Similarly, for example, as depicted in FIG. 2, the female rotor 3 has the cooling flow path 35 extending in the axial direction along the central axis line A2. For example, as depicted in FIG. 3, the cooling flow paths 25 and 35 are formed by through-holes penetrating the male and female rotors 2 and 3 in the axial direction. That is, the cooling flow paths 25 and 35 extend from distal ends of the discharge-side shaft sections 22 and 32 of the male and female rotors 2 and 3 to distal ends of the suction-side shaft section 23, and have openings on both sides.

In the present embodiment, a wall surface 25*a* (the inner circumferential surface of the through-hole) defining the cooling flow path 25 of the male rotor 2 is provided with a groove structure 26. For example, the groove structure 26 is provided over a region between the position of the discharge-side end face 21*b* and the mounting position of the discharge-side bearing 6 of the male rotor 2. The groove structure 26 includes grooves that have a length component in a circumferential direction (rotation direction) of the male rotor 2 and that is spaced apart in the axial direction. For example, the groove structure 26 includes a plurality of circular grooves 27 arranged at intervals in the axial direction.

A nozzle 15 for supplying the coolant is arranged inside the cooling flow path 25. The nozzle 15 is configured as a stationary member and is arranged with a gap between the nozzle 15 and the wall surface 25*a* of the cooling flow path 25. That is, the nozzle 15 has such a relation that the wall surface 25*a* of the cooling flow path 25 is relatively displaceable in the circumferential direction relative to an outer circumferential surface 15*a* of the nozzle 15. The nozzle 15 is arranged in such a manner as to overlap at least a part of the groove structure 26 of the wall surface 25*a* of the cooling flow path 25 at a position in the axial direction. For example, the nozzle 15 is inserted from an opening on the side of the discharge-side shaft section 22 of the cooling flow path 25, and extends from a position near the discharge-side end face 21*b* of the male rotor 2 to the distal end of the discharge-side shaft section 22, in the cooling flow path 25. A portion of the region of the nozzle 15 where the nozzle 15 overlaps the groove structure 26 is provided with a plurality of side holes 15*b* at intervals in the axial direction. The side holes 15*b* are configured as outlets of the coolant to the cooling flow path 25. The nozzle 15 is connected to the coolant supply line 74*a* of the external cooling system 70 directly or via a connection pipe.

In this manner, in the present embodiment, a predetermined region on the wall surface 25*a* of the cooling flow path 25 of the male rotor 2 (a region between the position of the discharge-side end face 21*b* of the male rotor 2 and the mounting position of the discharge-side bearing 6) is provided with the groove structure 26, and the nozzle 15, which is a stationary member, is arranged inside the cooling flow path 25 in such a manner as to overlap at least a part of the groove structure 26 in the axial direction. The inventors have found out that the groove structure 26 of the wall surface 25*a* of the cooling flow path 25 and the nozzle 15 as a stationary member in the cooling flow path 25 enhances the heat transfer coefficient between the coolant and the wall surface 25*a* of the cooling flow path 25, thereby allowing the capability to cool the discharge-side shaft section 22 of the male rotor 2 to be improved.

Figure 4:
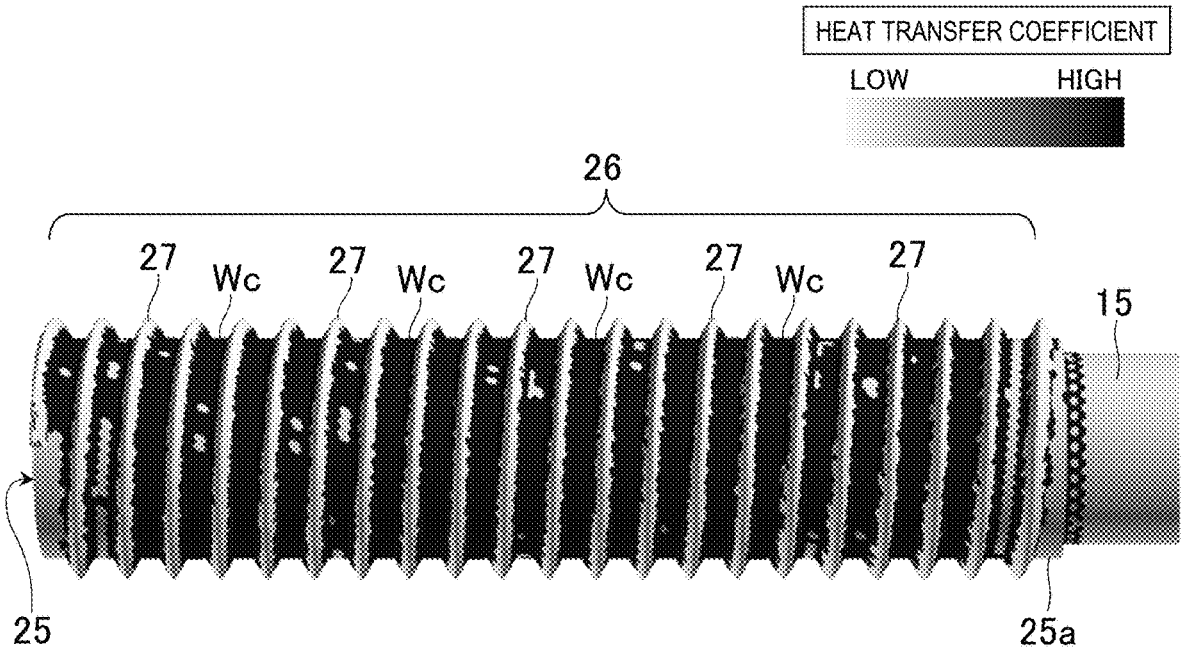
FIG. 4 is a figure depicting analysis results of distribution of coefficients of heat transfer with the cooling flow path of the screw rotor in the screw compressor according to the first embodiment.
Figure 5:
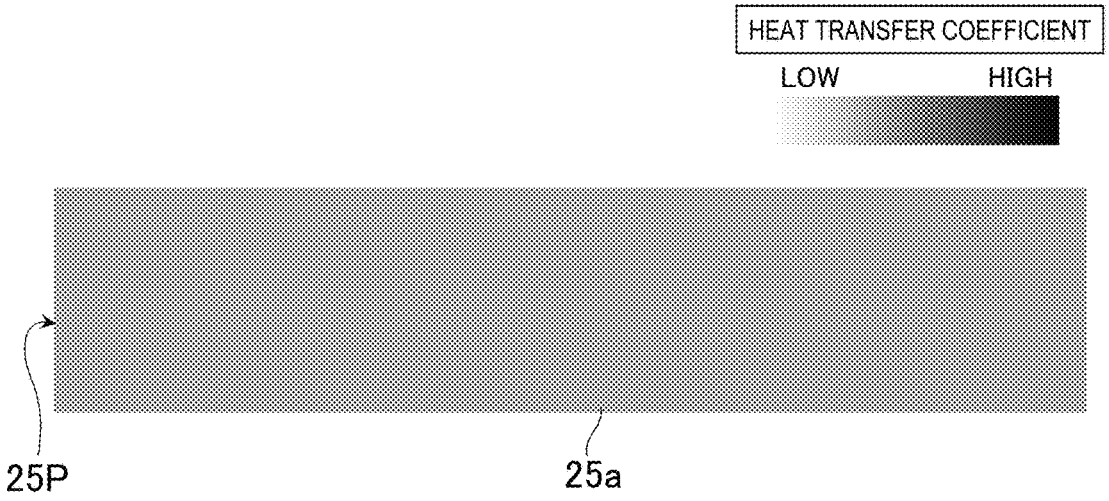
FIG. 5 is a figure depicting analysis results of distribution of heat transfer coefficients of a cooling flow path (without a groove structure) of a screw rotor according to an example for comparison with the cooling flow path of the screw rotor of the screw compressor according to the first embodiment.

Next, effects and advantages of the cooling system of the screw rotors in the screw compressor according to the first embodiment are explained by using FIG. 1 and FIG. 3 to FIG. 6. FIG. 4 is a figure depicting analysis results of distribution of coefficients of heat transfer with the cooling flow path of the screw rotor in the screw compressor according to the first embodiment. FIG. 5 is a figure depicting analysis results of distribution of heat transfer coefficients of a cooling flow path (without a groove structure) of a screw rotor according to an example for comparison with the cooling flow path of the screw rotor of the screw compressor according to the first embodiment.

In the screw compressor 1 depicted in FIG. 1, the lubricant as the coolant is supplied to the cooling flow path 25 of the male rotor 2 from the external cooling system 70. The coolant whose temperature has increased after cooling the male rotor 2 is fed to the cooler 72 by the pump 71 of the external cooling system 70, and is cooled in the cooler 72. The coolant whose temperature has been lowered by the cooler 72 is again introduced into the cooling flow path 25 of the male rotor 2 via the auxiliary element 73 and the coolant supply line 74*a*.

In the present embodiment, the coolant is supplied to the cooling flow path 25 of the male rotor 2 from the nozzle 15 via the coolant supply line 74*a* of the external cooling system 70. As depicted in FIG. 3, the coolant flows inside the nozzle 15 from the side of the distal end of the discharge-side shaft section 22 toward the side of the rotor lobe section 21, mostly flows into the cooling flow path 25 from a distal end of the nozzle 15, and partially flows into the cooling flow path 25 from the side holes 15*b* of the nozzle 15. In FIG. 3, outline arrows and thick arrows represent directions of the flow of the coolant (lubricant). The coolant having flowed into the cooling flow path 25 from the distal end of the nozzle 15 passes through the inside of the rotor lobe section 21 and the inside of the suction-side shaft section 23 sequentially. The coolant having flowed into the cooling flow path 25 from the side hole 15*b* positioned on the downstream side of the nozzle 15 flows toward the side of the rotor lobe section 21 through the gap between the wall surface 25*a* of the cooling flow path 25 and the outer circumferential surface 15*a* of the nozzle 15 (circular flow path). On the other hand, the coolant having flowed into the cooling flow path 25 from the side hole 15*b* positioned on the upstream side of the nozzle 15 flows toward the side of the discharge-side bearing 6 (in a direction which is opposite to the flow direction of the coolant in the nozzle 15) through the gap between the wall surface 25*a* of the cooling flow path 25 and the outer circumferential surface 15*a* of the nozzle 15 (circular flow path).

Meanwhile, one possible example of measures to improve the capability to cool the male rotor 2 is to lower the temperature of the coolant to be supplied to the cooling flow path 25. However, since the size of the cooler 72 of the external cooling system 70 needs to be increased in this case, the cost increases by a corresponding amount. Moreover, since the temperature of the coolant is restricted to a temperature equal to or higher than the temperature of the outside air in a case where the cooler 72 is an air-cooling type cooler, it is difficult to improve the cooling capability by lowering the temperature of the coolant.

Another possible measure to improve the cooling capability is to increase the flow rate of the coolant to be supplied to the cooling flow path 25. In this case, the flow rate of the coolant in the axial direction increases to improve the heat transfer coefficient near the wall surface 25*a* of the cooling flow path 25. However, since the size of the pump 71 of the external cooling system 70 needs to be increased in this case, the motive power of the pump 71 increases by a corresponding amount. Thus, the overall motive power of the compressor system increases in some cases.

In contrast, the present embodiment aims to improve the capability to cool the male rotor 2 by providing the groove structure 26 mentioned above to the predetermined region mentioned above on the wall surface 25*a* of the cooling flow path 25 of the male rotor 2, and arranging the nozzle 15 as a stationary member inside the cooling flow path 25 in such a manner as to overlap at least a part of the groove structure 26 in the axial direction, even in a case where the temperature or flow rate of the coolant of the male rotor 2 is set equivalent to those in conventional techniques.

As can be seen by referring to FIG. 4, the heat transfer coefficient is low at bottom regions of the respective circular grooves 27 of the groove structure 26 on the wall surface 25*a* of the cooling flow path 25. In contrast, it can be understood that the heat transfer coefficient is relatively increased on curved surface regions Wc that are positioned between adjacent circular grooves 27 of the groove structure 26 on the wall surface 25*a* of the cooling flow path 25 and that is free from irregularities.

On the other hand, as can be seen by referring to FIG. 5, the heat transfer coefficient is low on the wall surface 25*a* without a groove structure in a cooling flow path 25P of the screw rotor according to the comparative example (a curved surface region without irregularities over the entire region). It can be understood that the heat transfer coefficient on the wall surface 25*a* of the cooling flow path 25P without a groove structure according to the comparative example is lower than the heat transfer coefficient on the curved surface regions Wc that is free from irregularities and that lie between the circular grooves 27 of the groove structure 26 on the wall surface 25*a* of the cooling flow path 25 with the groove structure 26 according to the present embodiment.

That is, since the heat transfer coefficient between the coolant and the wall surface 25*a* with the groove structure 26 in the cooling flow path 25 of the male rotor 2 increases in the present embodiment, the amount of heat that moves from the male rotor 2 to the coolant increases even in a case where the temperature or flow rate of the coolant is set equivalent to those in conventional techniques. As a result, a temperature increase of the male rotor 2 is suppressed, and accordingly, the thermal deformation amount of the male rotor 2 in the axial direction can be reduced. This results in suppressing enlargement of the gap between the discharge-side end face 21*b* of the male rotor 2 and the discharge-side inner wall surface 48 of the casing 4 (discharge-side end face gap) to reduce the internal leak amount of the compressed gas, and thus the efficiency of the compressor can be improved.

Figure 6:
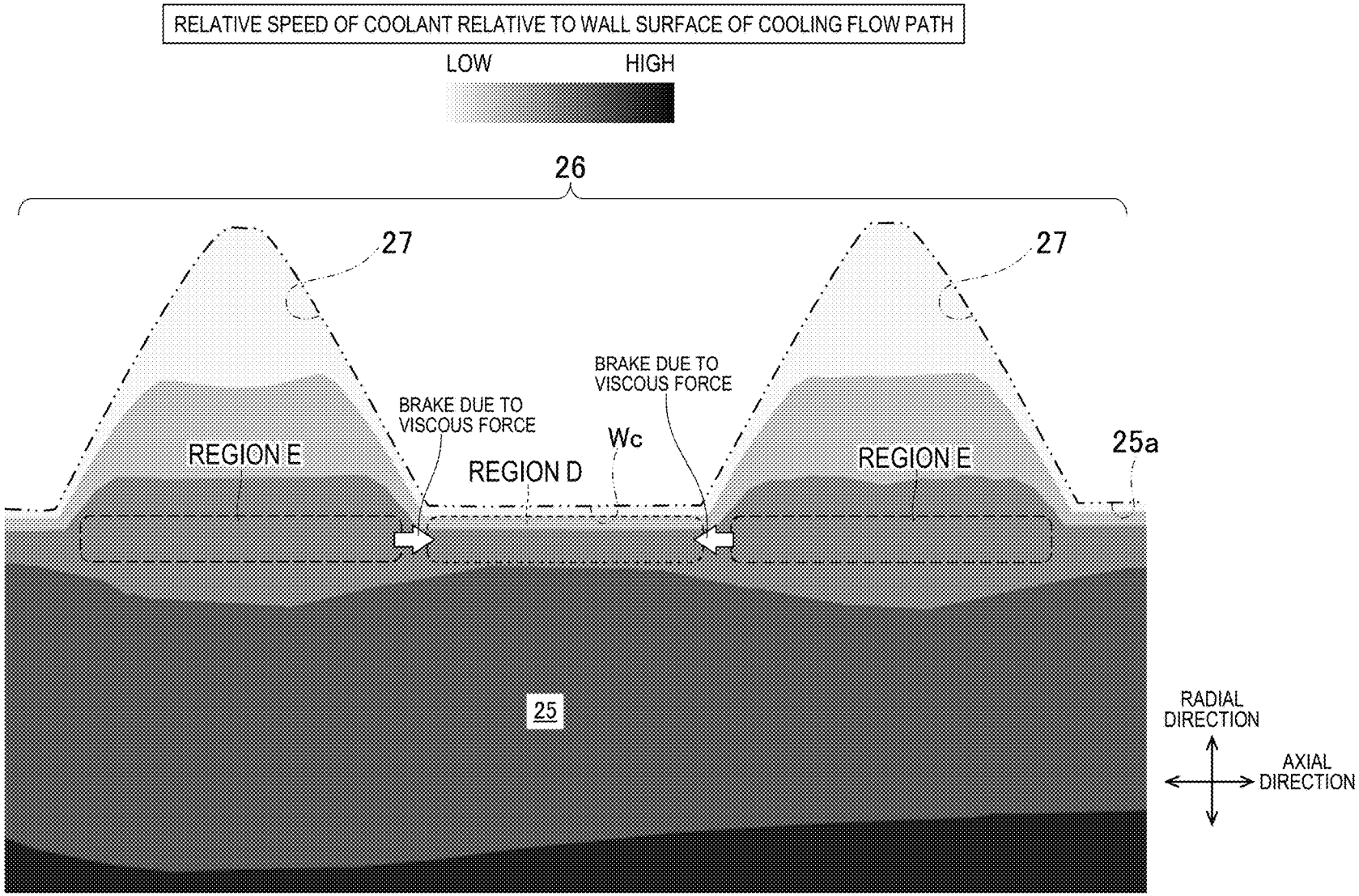
FIG. 6 is an explanatory diagram depicting effects of the cooling flow path of the screw rotor in the screw compressor according to the first embodiment.

Here, a reason why the heat transfer coefficient on the wall surface of the cooling flow path is increased by providing the groove structure on the wall surface is explained by using FIG. 6. FIG. 6 is a figure depicting distribution of relative speeds (circumferential speeds) of the coolant relative to the wall surface of the cooling flow path of the screw rotor according to the first embodiment. In FIG. 6, a two-dot chain line represents the wall surface of the cooling flow path. The region under the two-dot chain line is a region where the coolant flows. In addition, outline arrows represent a viscous force acting on the coolant in a region D.

It is generally known that the heat transfer coefficient increases as the relative speed of a fluid relative to a solid wall surface increases.

The relative speed (circumferential speed) of the coolant relative to the wall surface 25*a* of the cooling flow path 25 lowers in the region D positioned near the curved surface region Wc (e.g., a region of a cylindrical surface) that is positioned between one circular groove 27 and another circular groove 27 (between one groove and another groove that are positioned at an interval in the axial direction) of the groove structure 26 on the wall surface 25*a* of the cooling flow path 25 and that is free from irregularities. This is because a shear force generated between the coolant and the wall surface 25*a* of the cooling flow path 25 that moves in the rotation direction of the male rotor 2 causes the coolant to move in the same direction (circumferential direction) as the wall surface 25*a* of the cooling flow path 25.

On the other hand, in regions E that are regions adjacent to the region D in the axial direction of the male rotor 2, the distances to the bottom surfaces or side surfaces of the circular grooves 27 of the groove structure 26 as the wall surface of the cooling flow path 25 positioned in the radial direction are relatively long, as compared with the distances between the region D and the curved surface regions Wc without irregularities. Because of this, a shear force that acts on the coolant flowing in the regions E is relatively small as compared with a case of the coolant flowing in the region D, and accordingly, relative speeds (circumferential speeds) of the coolant in the regions E relative to the wall surface 25*a* of the cooling flow path 25 are great as compared with the case of the coolant in the region D.

This causes speed differences to be generated between the coolant in the region D and the coolant in the regions E. Accordingly, the viscous force acting between the coolant in the region D and the coolant in the regions E functions as a brake on the coolant in the region D, and the flow rate (circumferential speed) in the region D lowers. Hence, the relative speed of the coolant flowing in the region D relative to the wall surface 25*a* of the cooling flow path 25 increases, and the heat transfer coefficient in the region D thus increases by a corresponding amount as compared with the case of the wall surface 25*a* of the cooling flow path 25P without the groove structure 26 (see FIG. 5).

In addition, in the present embodiment, as depicted in FIG. 3, the nozzle 15, which is a stationary member, is arranged inside the cooling flow path 25 with a gap between the nozzle 15 and the wall surface 25*a* of the cooling flow path 25, and also is arranged in such a manner as to overlap a part of the groove structure 26 at a position in the axial direction of the male rotor 2. This causes a shear force to be generated between the nozzle 15 as a stationary member and the coolant, and thus the speed of the coolant flowing near the outer circumferential surface 15*a* of the nozzle 15 lowers. As a result, the coolant flowing on the side of the rotating wall surface 25*a* of the cooling flow path 25 (e.g., the coolant in the region D and the coolant in the regions E depicted in FIG. 6) is influenced by the coolant with a lowered speed near the nozzle 15, and accordingly, the relative speed of the coolant flowing on the side of the wall surface 25*a* of the cooling flow path 25 relative to the wall surface 25*a* of the cooling flow path 25 increases as compared with the case where there is not the nozzle 15.

In this manner, providing the groove structure 26 on the wall surface 25*a* of the cooling flow path 25 causes the relative speed (circumferential speed) of the coolant relative to the wall surface 25*a* of the cooling flow path 25 to increase. In addition, arranging the nozzle 15, which is a stationary member, inside the cooling flow path 25 in such a manner as to overlap at least a part of the groove structure 26 in the axial direction causes the relative speed (circumferential speed) of the coolant relative to the wall surface 25*a* of the cooling flow path 25 to increase. Therefore, the heat transfer coefficient between the coolant and the wall surface 25*a* having the groove structure 26 of the cooling flow path 25 can be enhanced.

As mentioned above, the screw compressor 1 according to the present embodiment includes the male rotor 2 (screw rotor) and the discharge-side bearing 6. The male rotor 2 (screw rotor) includes the rotor lobe section 21 that has the twisted lobes 21*a* and has the discharge-side end face 21*b* on one side in the axial direction, and the discharge-side shaft section 22 provided on the one side in the axial direction at the rotor lobe section 21. The discharge-side bearing 6 is mounted on the discharge-side shaft section 22. The male rotor 2 (screw rotor) has the cooling flow path 25 extending in the axial direction at least inside the discharge-side shaft section 22. The groove structure 26 is provided at least at a part of the region on the wall surface 25*a* of the cooling flow path 25 between the position of the discharge-side end face 21*b* in the axial direction and the mounting position of the discharge-side bearing 6, and the groove structure 26 includes the grooves 27 that have a lengthwise component in the circumferential direction of the male rotor 2 (screw rotor) and that is spaced apart in the axial direction. The nozzle 15 which is a stationary member for supplying the coolant is arranged inside the cooling flow path 25 with a gap between the nozzle 15 and the wall surface 25*a*, and is arranged in such a manner as to overlap at least a part of the groove structure 26 in the axial direction.

According to this configuration, the relative speed of the coolant, which flows in the region D near a wall surface Wc positioned between the grooves 27 of the groove structure 26 in the cooling flow path 25, relative to the wall surface Wc increases due to an influence of the coolant flowing in the regions E at groove positions adjacent in the axial direction. In addition, the relative speed of the coolant flowing on the side of the wall surface 25*a* of the cooling flow path 25 relative to the wall surface 25*a* increases due to an influence of the coolant flowing near the nozzle 15 as a stationary member. Those enhance the heat transfer coefficient on the wall surface 25*a* of the cooling flow path 25 having the groove structure 26, thereby improving the capability to cool the discharge-side shaft section 22 of the male rotor 2 (screw rotor). That is, the capability to cool the discharge-side shaft section 22 of the male rotor 2 (screw rotor) can be enhanced with a simple structure.

In addition, in the present embodiment, the groove structure 26 includes the plurality of circular grooves 27 arranged at intervals in the axial direction. According to this configuration, the groove structure 26 has a simple structure, and accordingly, the groove structure 26 can be machined easily.

In addition, in the present embodiment, the groove structure 26 is provided over the entire region between the position of the discharge-side end face 21*b* and the mounting position of the discharge-side bearing 6. This configuration can enhance the capability to cool the entire region that significantly influences enlargement of the discharge-side end face gap at the discharge-side shaft section 22, and can therefore reduce more effectively enlargement of the discharge-side end face gap due to thermal deformation of the discharge-side shaft section 22.

Modification Example of First Embodiment

Figure 7:
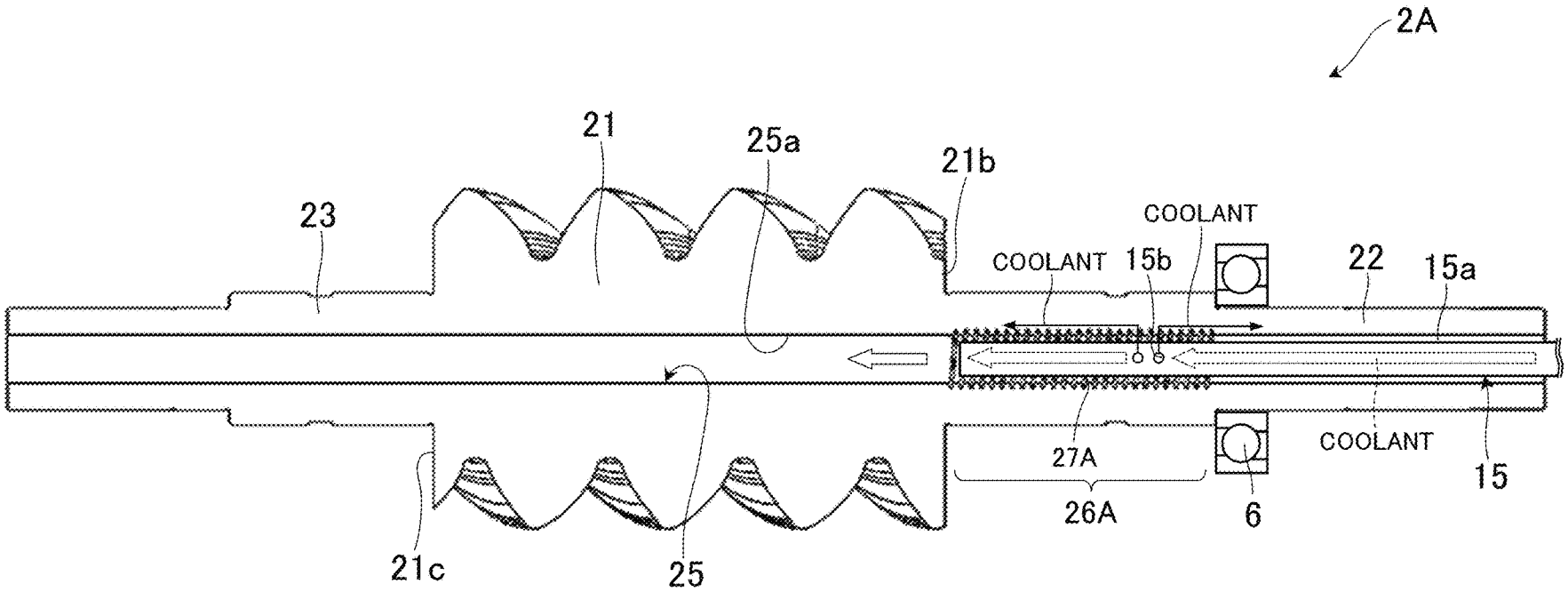
FIG. 7 is a cross-sectional view depicting the structure of a cooling flow path and the arrangement of a nozzle of a screw rotor in a screw compressor according to a modification example of the first embodiment.

A screw compressor according to a modification example of the first embodiment is illustratively explained by using FIG. 7. FIG. 7 is a cross-sectional view depicting the structure of the cooling flow path and the arrangement of the nozzle of a screw rotor in the screw compressor according to the modification example of the first embodiment. Note that those denoted by the same reference characters in FIG. 7 as the reference characters depicted in FIG. 1 to FIG. 6 are similar portions, and accordingly, detailed explanations thereof are omitted.

A difference of the screw compressor according to the modification example of the first embodiment depicted in FIG. 7 from the first embodiment lies in a groove structure 26A of the cooling flow path 25 of a male rotor 2A (screw rotor). Specifically, the groove structure 26A of the cooling flow path 25 of the male rotor 2A includes one helical groove 27A extending in the axial direction of the male rotor 2A. The helical groove 27A is a groove that has a length component in the rotation direction (circumferential direction) of the male rotor 2A and that is spaced apart in the axial direction. The direction of winding of the helical groove 27A can be any of the clockwise direction and the counter-clockwise direction.

Also in the case where the groove structure 26A of the cooling flow path 25 includes the helical groove 27A, as in the first embodiment, a speed difference is generated between the coolant flowing in the region D (see FIG. 6) near the region Wc (see FIG. 6) of the wall surface 25*a* of the cooling flow path 25, which region Wc is positioned between the turns of the helical groove 27A spaced apart in the axial direction of the groove structure 26A, and the coolant flowing in the regions E (see FIG. 6) which are at groove positions and axially adjacent to the region D. Because of this, the relative speed of the coolant flowing in the region D relative to the wall surface 25*a* of the cooling flow path 25 increases, and accordingly, the heat transfer coefficient in the region D increases by a corresponding amount as compared with the case of the wall surface 25*a* of the cooling flow path 25P without the groove structure 26 (see FIG. 5).

In this manner, increase of the heat transfer coefficient between the coolant and the wall surface 25*a* having the groove structure 26A in the cooling flow path 25 of the male rotor 2A causes the amount of heat that transfers from the male rotor 2A to the coolant to increase even in a case where the temperature or flow rate of the coolant is set equivalent to those in conventional techniques. As a result, a temperature increase of the male rotor 2A is suppressed, and accordingly, the thermal deformation amount of the male rotor 2A in the axial direction can be reduced. This suppresses enlargement of the gap between the discharge-side end face 21*b* of the male rotor 2A and the inner wall surface 48 of the casing 4 (discharge-side end face gap) to reduce the internal leak amount of the compressed gas, and thus the efficiency of the compressor can be improved.

Note that the groove structure 26A of the cooling flow path 25 includes the one helical groove 27A in the example depicted in the present modification example. However, the groove structure 26A of the cooling flow path 25 can include a plurality of helical grooves 27A, in another possible manner of configuration.

In the modification example of the first embodiment mentioned above, as in the first embodiment, the groove structure 26A is provided on the wall surface 25*a* of the cooling flow path 25, and the nozzle 15 which is a stationary member is arranged inside the cooling flow path 25 in such a manner as to overlap at least a part of the groove structure 26A. This enhances the heat transfer coefficient on the wall surface 25*a* of the cooling flow path 25 having the groove structure 26A, thereby improving the capability to cool the discharge-side shaft section 22 of the male rotor 2A (screw rotor). That is, the capability to cool the discharge-side shaft section 22 of the male rotor 2A (screw rotor) can be enhanced with a simple structure.

Also in the present modification example, the groove structure 26A includes the helical groove 27A. According to this configuration, the helical groove 27A as the groove structure 26A can be provided over a wide range in the axial direction on the wall surface of the cooling flow path 25 by machining performed once, and man-hours and manufacturing costs can be therefore reduced as compared with the case of the first embodiment.

Second Embodiment

Figure 8:
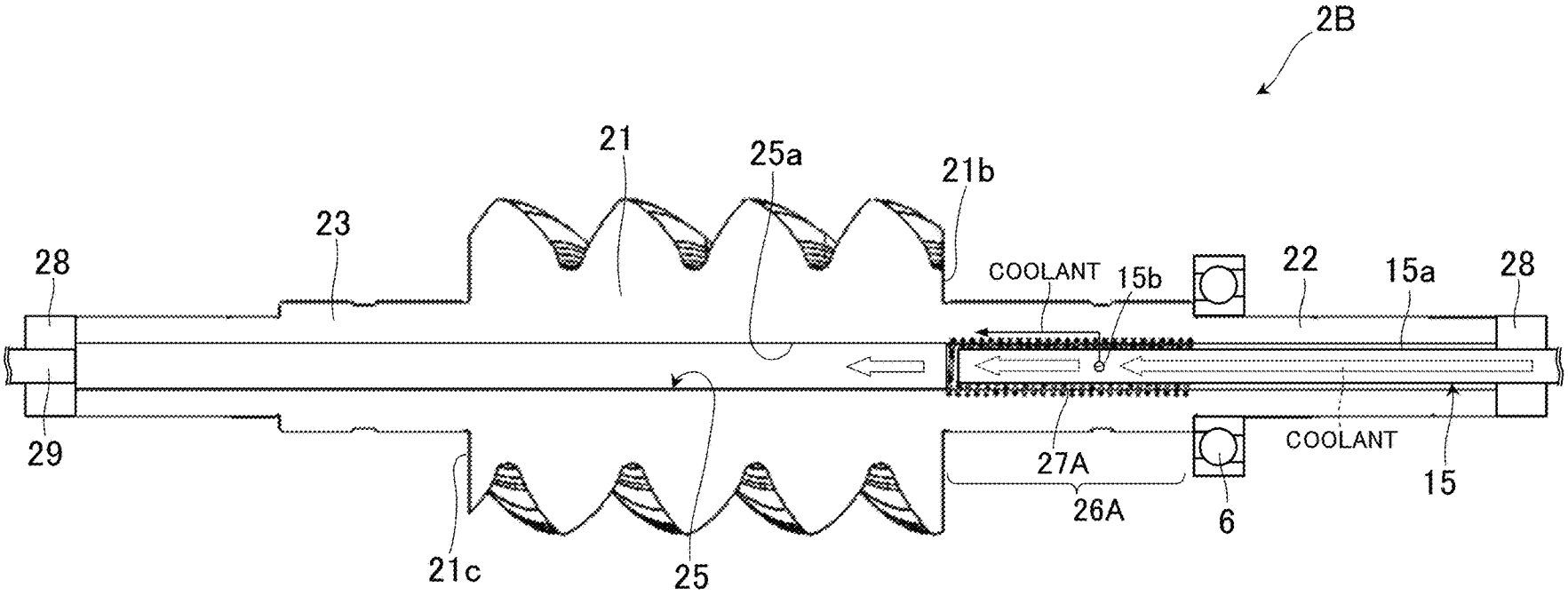
FIG. 8 is a cross-sectional view depicting the structure of a screw rotor in a screw compressor according to a second embodiment of the present invention.

A screw compressor according to a second embodiment is illustratively explained by using FIG. 8. FIG. 8 is a cross-sectional view depicting the structure of a screw rotor in the screw compressor according to the second embodiment of the present invention. In FIG. 8, outline arrows and a thick arrow represent directions of the flow of the coolant (lubricant). Note that those denoted by the same reference characters in FIG. 8 as the reference characters depicted in FIG. 1 to FIG. 7 are similar portions, and accordingly, detailed explanations thereof are omitted.

A difference of the screw compressor according to the second embodiment depicted in FIG. 8 from the modification example (see FIG. 7) of the first embodiment is that sealing members 28 are provided to openings on both sides in the axial direction of the through-hole as the cooling flow path 25 of a male rotor 2B (screw rotor). The sealing members 28 are provided for preventing entry of a fluid other than the coolant to the inside of the cooling flow path 25. For example, one sealing member 28 is mounted at a distal end portion of the discharge-side shaft section 22 of the male rotor 2B in a state where the nozzle 15 has penetrated this sealing member 28, in such a manner as to block the cooling flow path 25. For example, the other sealing member 28 is mounted at a distal end portion of the suction-side shaft section 23 of the male rotor 2B in a state where a discharge pipe 29 has penetrated this sealing member 28, in such a manner as to block the cooling flow path 25. The discharge pipe 29 is provided for discharging the coolant supplied to the cooling flow path 25 from the nozzle 15, to the outside of the male rotor 2B.

In the present embodiment, as depicted in FIG. 8, the coolant supplied to the nozzle 15 flows into the cooling flow path 25 from the distal end of the nozzle 15, and also flows into the cooling flow path 25 from the side holes 15*b* of the nozzle 15. The coolant having flowed into the cooling flow path 25 from the distal end of the nozzle 15 passes through the inside of the rotor lobe section 21 and the inside of the suction-side shaft section 23 sequentially. The coolant having flowed into the cooling flow path 25 from the side holes 15*b* of the nozzle 15 flows only toward the side of the rotor lobe section 21 through the gap between the wall surface 25*a* of the cooling flow path 25 and the outer circumferential surface 15*a* of the nozzle 15 (circular flow path) since the opening of the cooling flow path 25 on the side of the discharge-side shaft section 22 is blocked by the sealing member 28.

Meanwhile, in the modification example (see FIG. 7) of the first embodiment mentioned before, both sides in the axial direction of the cooling flow path 25 of the male rotor 2A are open. Because of this, there is a concern that a gas such as outside air enters the inside from the openings of the cooling flow path 25. If a gas enters the inside of the cooling flow path 25, the coolant with relatively high density moves to the side of the wall surface 25*a* of the cooling flow path 25 on the radially outer side of the male rotor 2A due to a centrifugal force. On the other hand, the gas with relatively low density moves to the side of the outer circumferential surface 15*a* of the nozzle 15 on the radially inner side of the male rotor 2A and forms a layer undesirably in some cases. Since the area size of contact between the outer circumferential surface 15*a* of the nozzle 15 and the coolant decreases if a layer of the gas is formed on the outer circumferential surface 15*a* of the nozzle 15, a shear force generated between the nozzle 15 as a stationary member and the coolant decreases. As a result, the advantage of increase of the relative speed of the coolant relative to the wall surface 25*a* of the cooling flow path 25 mentioned before is decreased undesirably.

In contrast, in the present embodiment, entry of a gas to the inside of the cooling flow path 25 is inhibited by providing the sealing members 28 to the openings of the cooling flow path 25. This causes the coolant supplied to the cooling flow path 25 from the nozzle 15 to fill the inside of the cooling flow path 25, and thus a decrease of the area size of contact between the outer circumferential surface 15*a* of the nozzle 15 and the coolant is avoided. Accordingly, the advantage of increase of the relative speed of the coolant relative to the wall surface 25*a* of the cooling flow path 25 attained by arranging the nozzle 15, which is a stationary member, in the cooling flow path 25 can be attained surely.

In the second embodiment mentioned above, as in the modification example of the first embodiment, the groove structure 26A is provided on the wall surface 25*a* of the cooling flow path 25, and the nozzle 15 which is a stationary member is arranged inside the cooling flow path 25 in such a manner as to overlap at least a part of the groove structure 26A. This enhances the heat transfer coefficient on the wall surface 25*a* of the cooling flow path 25 having the groove structure 26A, thereby improving the capability to cool the discharge-side shaft section 22 of the male rotor 2B (screw rotor). That is, the capability to cool the discharge-side shaft section 22 of the male rotor 2B (screw rotor) can be enhanced with a simple structure.

In addition, in the present embodiment, the cooling flow path 25 is formed by the through-hole penetrating the male rotor 2B (screw rotor) in the axial direction, and the sealing members 28 that prevent entry of a fluid other than the coolant into the cooling flow path 25 are provided to the openings of the cooling flow path 25 in the axial direction.

According to this configuration, the sealing members 28 can inhibit entry of a fluid other than the coolant to the inside of the cooling flow path 25, thereby avoiding a decrease of the area size of contact between the outer circumferential surface 15*a* of the nozzle 15 and the coolant, which decrease might be caused by the fluid having entered. This allows the advantage of increase of the relative speed of the coolant relative to the wall surface 25*a* of the cooling flow path 25 to be attained surely. Accordingly, the heat transfer coefficient on the wall surface 25*a* having the groove structure 26A of the cooling flow path 25 is enhanced, and the capability to cool the discharge-side shaft section 22 of the male rotor 2B (screw rotor) is improved.

Third Embodiment

Figure 9:
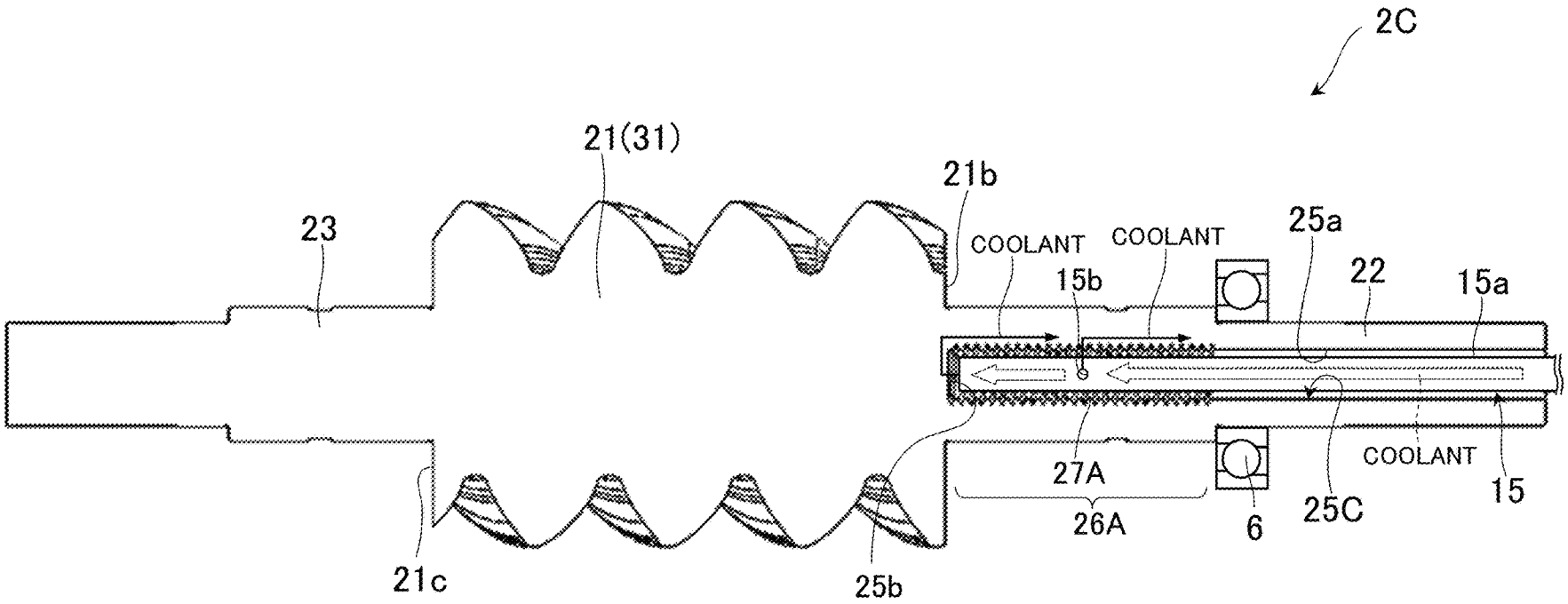
FIG. 9 is a cross-sectional view depicting the structure of a screw rotor in a screw compressor according to a third embodiment of the present invention.

A screw compressor according to a third embodiment is illustratively explained by using FIG. 9. FIG. 9 is a cross-sectional view depicting the structure of a screw rotor in the screw compressor according to the third embodiment of the present invention. In FIG. 9, outline arrows and thick arrows represent directions of the flow of the coolant (lubricant). Note that those denoted by the same reference characters in FIG. 9 as the reference characters depicted in FIG. 1 to FIG. 8 are similar portions, and accordingly, detailed explanations thereof are omitted.

A difference of the screw compressor according to the third embodiment depicted in FIG. 9 from the modification example (see FIG. 7) of the first embodiment is that a cooling flow path 25C of a male rotor 2C (screw rotor) is formed not by a through-hole but by a bottomed hole having an opening on one side. For example, the cooling flow path 25C is formed in such a manner as to extend from a distal end of the discharge-side shaft section 22 of the male rotor 2C to the position of the discharge-side end face 21*b* of the rotor lobe section 21, have an opening on the side of the distal end of the discharge-side shaft section 22, and also have a bottom 25*b* at the position of the discharge-side end face 21*b*. That is, the male rotor 2C has the discharge-side shaft section 22 configured as a hollow shaft section and the suction-side shaft section 23 configured as a solid shaft section. As in the modification example of the of the first embodiment, the groove structure 26A on the wall surface 25*a* of the cooling flow path 25C includes the helical groove 27A provided over the region between the position of the discharge-side end face 21*b* of the rotor lobe section 21 and the mounting position of the discharge-side bearing 6.

In the present embodiment, as depicted in FIG. 9, the coolant having flowed into the cooling flow path 25C from the distal end of the nozzle 15 makes a turn due to the bottom 25*b* of the cooling flow path 25C, and flows toward the opening on the side of the distal end of the discharge-side shaft section 22 through the gap between the wall surface 25*a* of the cooling flow path 25C and the outer circumferential surface 15*a* of the nozzle 15 (circular flow path). In addition, along with the coolant having made a turn at the bottom 25*b* of the cooling flow path 25C, the coolant having flowed into the cooling flow path 25C from the side holes 15*b* of the nozzle 15 flows toward the opening on the side of the distal end of the discharge-side shaft section 22 through the gap between the wall surface 25*a* of the cooling flow path 25C and the outer circumferential surface 15*a* of the nozzle 15 (circular flow path). The coolant having flowed into the cooling flow path 25C from the nozzle 15 is discharged from the opening of the cooling flow path 25C. At this time, the coolant flowing through the cooling flow path 25C pushes and discharges a gas staying in the cooling flow path 25C to the opening of the cooling flow path 25C, and thus the inside of the cooling flow path 25C gets filled with the coolant.

In this manner, the cooling flow path 25C of the male rotor 2C is formed by a bottomed hole having an opening on one side. This can inhibit entry of outside air to the cooling flow path 25C. Accordingly, as in the second embodiment, it is possible to prevent a decrease of the area size of contact between the outer circumferential surface 15*a* of the nozzle 15 and the coolant, which decrease might be caused by the formation of a layer on the outer circumferential surface 15*a* of the nozzle 15 by a gas having entered the cooling flow path 25C. That is, without using the sealing members 28 in the second embodiment, entry of outside air to the cooling flow path 25C can be inhibited as in the case of the second embodiment.

In the third embodiment mentioned above, as in the modification example of the first embodiment, the groove structure 26A is provided on the wall surface 25*a* of the cooling flow path 25C, and the nozzle 15 which is a stationary member is arranged inside the cooling flow path 25C in such a manner as to overlap at least a part of the groove structure 26A. This enhances the heat transfer coefficient on the wall surface 25*a* of the cooling flow path 25C having the groove structure 26A, thereby improving the capability to cool the discharge-side shaft section 22 of the male rotor 2C (screw rotor). That is, the capability to cool the discharge-side shaft section 22 of the male rotor 2C (screw rotor) can be enhanced with a simple structure.

In addition, in the present embodiment, the cooling flow path 25C is formed by a bottomed hole having an opening on the side of the distal end of the discharge-side shaft section 22. According to this configuration, the coolant supplied to the cooling flow path 25C makes a turn at the bottom 25*b* of the cooling flow path 25C and flows out from the opening of the cooling flow path 25C. This allows entry of a fluid other than the coolant to the cooling flow path 25C to be inhibited without using sealing members 28 like those in the second embodiment. Accordingly, as compared with the second embodiment, it is possible to reduce the number of parts, and also to attempt to reduce man-hours and manufacturing costs.

Fourth Embodiment

Figure 10:
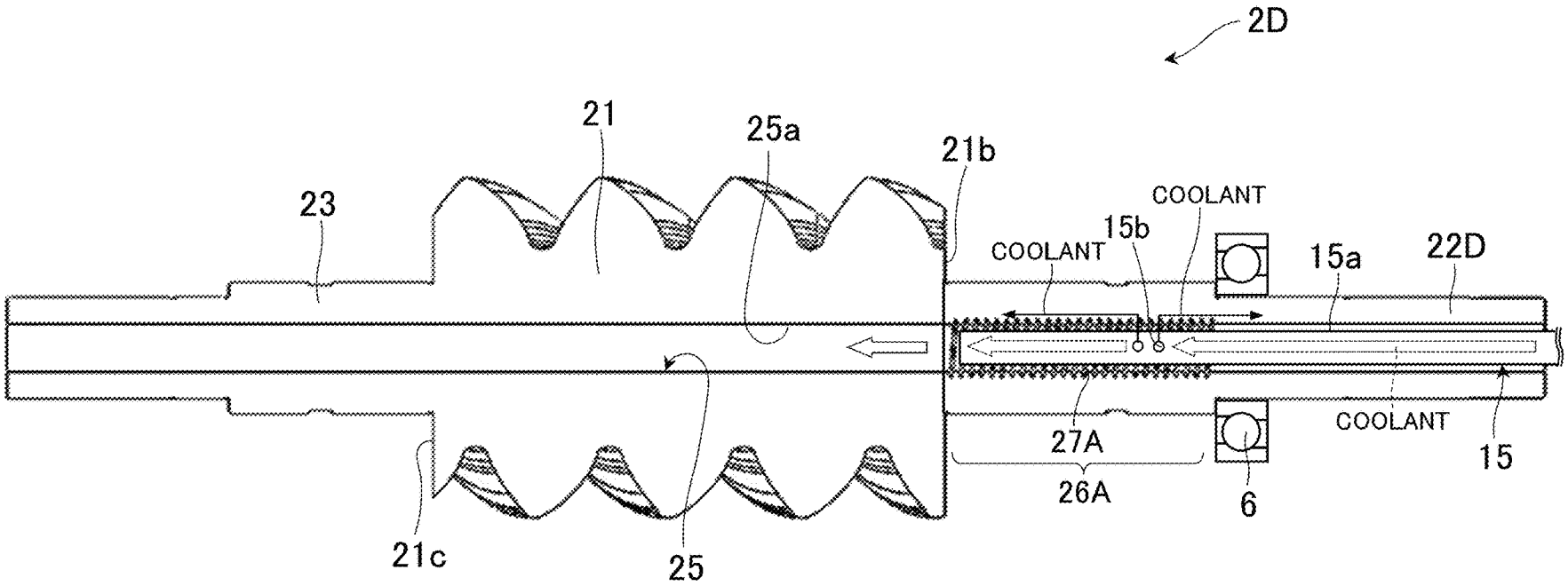
FIG. 10 is a cross-sectional view depicting the structure of a screw rotor in a screw compressor according to a fourth embodiment of the present invention.

A screw compressor according to a fourth embodiment is illustratively explained by using FIG. 10. FIG. 10 is a cross-sectional view depicting the structure of a screw rotor in the screw compressor according to the fourth embodiment of the present invention. In FIG. 10, outline arrows and thick arrows represent directions of the flow of the coolant (lubricant). Note that those denoted by the same reference characters in FIG. 10 as the reference characters depicted in FIG. 1 to FIG. 9 are similar portions, and accordingly, detailed explanations thereof are omitted.

A difference of the screw compressor according to the fourth embodiment depicted in FIG. 10 from the modification example (see FIG. 7) of the first embodiment is that the rotor lobe section 21 and a discharge-side shaft section 22D of a male rotor 2D (screw rotor) are configured not by using one integrated member but by using separate members. Specifically, the male rotor 2D includes the rotor lobe section 21 and the suction-side shaft section 23 as one member formed integrally, and the discharge-side shaft section 22D which is one member separate from the rotor lobe section 21 and the suction-side shaft section 23. The discharge-side shaft section 22D is joined at a portion on the side of its base end with a portion on the side of the discharge-side end face 21*b* of the rotor lobe section 21. The rotor lobe section 21 and the discharge-side shaft section 22D are connected together by friction welding or welding, for example. The groove structure 26A is formed over a region from the position of an end on the joined side (the left side in FIG. 10) of the discharge-side shaft section 22D in the cooling flow path 25 to the mounting position of the discharge-side bearing.

In the male rotor 2D according to the present embodiment, the groove structure 26A can be machined on the wall surface 25*a* of the cooling flow path 25 of the discharge-side shaft section 22D at a step before the discharge-side shaft section 22D is joined to the rotor lobe section 21. This allows a machining device for machining the groove structure 26A to be inserted from the opening on the joined side of the discharge-side shaft section 22D in the cooling flow path 25. This machining method makes it easy to insert the machining device as compared with a case where the machining device is inserted from the opening on the side of the distal end of the discharge-side shaft section, and thus leads to reduction in machining time for the groove structure 26A.

In the fourth embodiment mentioned above, as in the modification example of the first embodiment, the groove structure 26A is provided on the wall surface 25*a* of the cooling flow path 25, and the nozzle 15 which is a stationary member is arranged inside the cooling flow path 25 in such a manner as to overlap at least a part of the groove structure 26A. This enhances the heat transfer coefficient on the wall surface 25*a* of the cooling flow path 25 having the groove structure 26A, thereby improving the capability to cool the discharge-side shaft section 22D of the male rotor 2D (screw rotor). That is, the capability to cool the discharge-side shaft section 22 of the male rotor 2D (screw rotor) can be enhanced with a simple structure.

In addition, in the present embodiment, the discharge-side shaft section 22D is formed as a member separate from the rotor lobe section 21, and the cooling flow path 25 penetrates the discharge-side shaft section 22D. According to this configuration, the groove structure 26A can be machined on the wall surface 25*a* of the cooling flow path 25 of the discharge-side shaft section 22D before the discharge-side shaft section 22D is joined to the rotor lobe section 21. This makes it easy to align the discharge-side shaft section 22D relative to a machining device for machining the groove structure 26A or to insert the machining device into the cooling flow path 25 as compared with the case where the rotor lobe section 21 and the discharge-side shaft section 22 are formed as one integrated member, and it thus becomes easier to machine the groove structure 26A.

Modification Example of Fourth Embodiment

Figure 11:
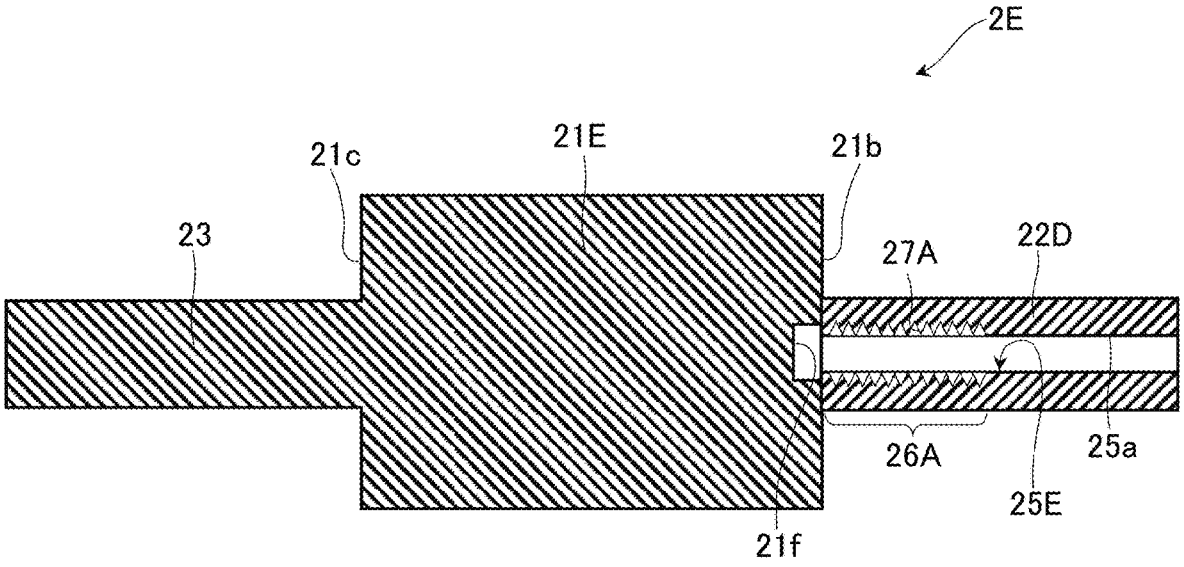
FIG. 11 is a schematic diagram depicting the structure of a screw rotor in a screw compressor according to a modification example of the fourth embodiment of the present invention.
Figure 12:
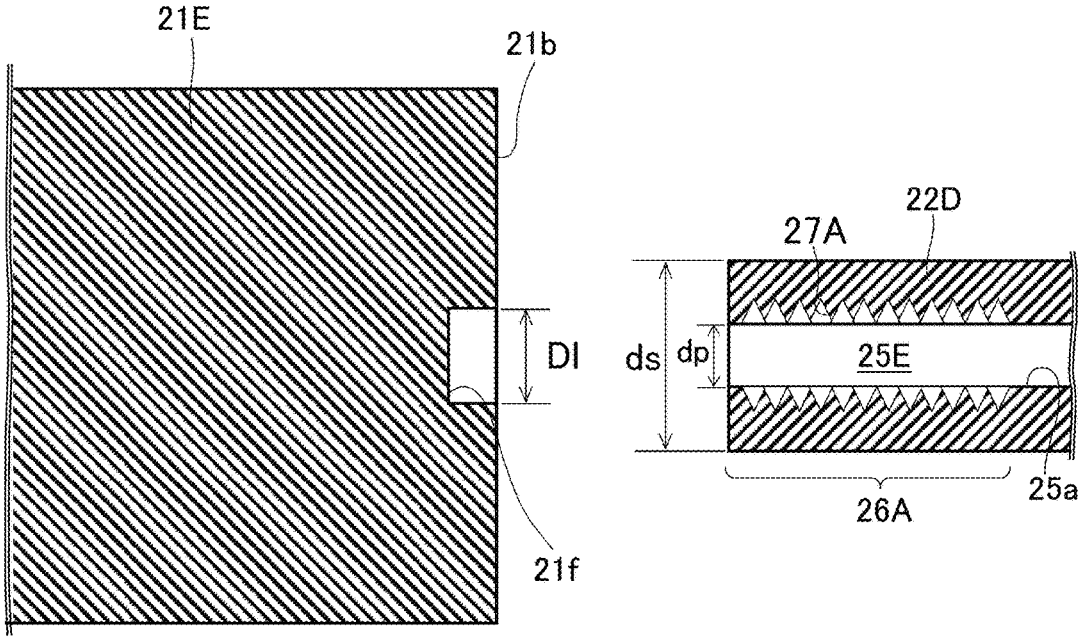
FIG. 12 is a schematic diagram depicting the dimensional relation between a recess of a rotor lobe section and a discharge-side shaft section in the screw rotor depicted in FIG. 11.

A screw compressor according to a modification example of the fourth embodiment is illustratively explained. First, the structure of a screw rotor in the screw compressor according to the modification example of the fourth embodiment is explained by using FIG. 11 and FIG. 12. FIG. 11 is a schematic diagram depicting the structure of the screw rotor in the screw compressor according to the modification example of the fourth embodiment of the present invention. FIG. 12 is a schematic diagram depicting the dimensional relation between a recess of the rotor lobe section and the discharge-side shaft section in the screw rotor depicted in FIG. 11. Note that those denoted by the same reference characters in FIG. 11 and FIG. 12 as the reference characters depicted in FIG. 1 to FIG. 10 are similar portions, and accordingly, detailed explanations thereof are omitted.

A difference of the screw compressor according to the modification example of the fourth embodiment depicted in FIG. 11 from the fourth embodiment (see FIG. 10) is that a cooling flow path 25E of a male rotor 2E is provided only at the discharge-side shaft section 22D, and that a recess 21*f* is provided at a portion of a rotor lobe section 21E at which the discharge-side shaft section 22D is joined (the position of the discharge-side end face 21*b*).

Specifically, the male rotor 2E includes the rotor lobe section 21E and the suction-side shaft section 23 as one member formed integrally, and the discharge-side shaft section 22D as one member. A through-hole penetrating the discharge-side shaft section 22D in the axial direction is formed as the cooling flow path 25E. The one member including the rotor lobe section 21E and the suction-side shaft section 23 is configured without a cooling flow path. That is, the cooling flow path 25E is positioned only in the discharge-side shaft section 22D. The recess 21*f* is provided on an end face (at the position of the discharge-side end face 21*b*) of the rotor lobe section 21E on the side of the portion at which the discharge-side shaft section 22D is joined. As depicted in FIG. 12, a diameter Dl of the recess 21*f* of the rotor lobe section 21E is set smaller than an outer diameter ds of the discharge-side shaft section 22D but greater than a diameter dp of the cooling flow path 25E (through-hole) of the discharge-side shaft section 22D. The portion on the side of the discharge-side end face 21*b* of the rotor lobe section 21E and an end face on the side (the left side in FIG. 11) of the base end of the discharge-side shaft section 22D are joined by friction welding.

Figure 13:
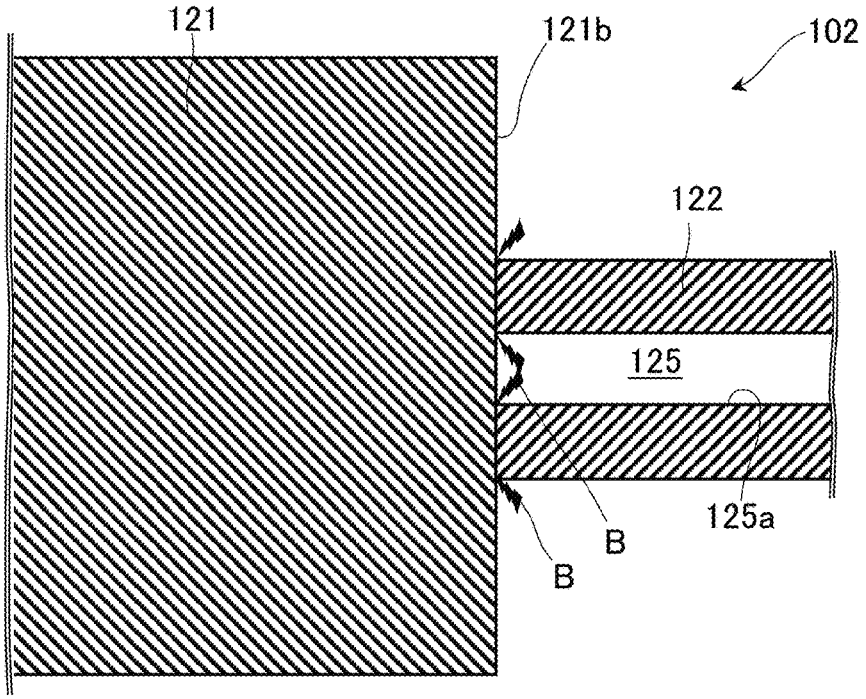
FIG. 13 is an explanatory diagram depicting a state obtained after a discharge-side shaft section in a screw rotor according to an example for comparison with the screw rotor of the screw compressor according to the modification example of the fourth embodiment is joined.
Figure 14:
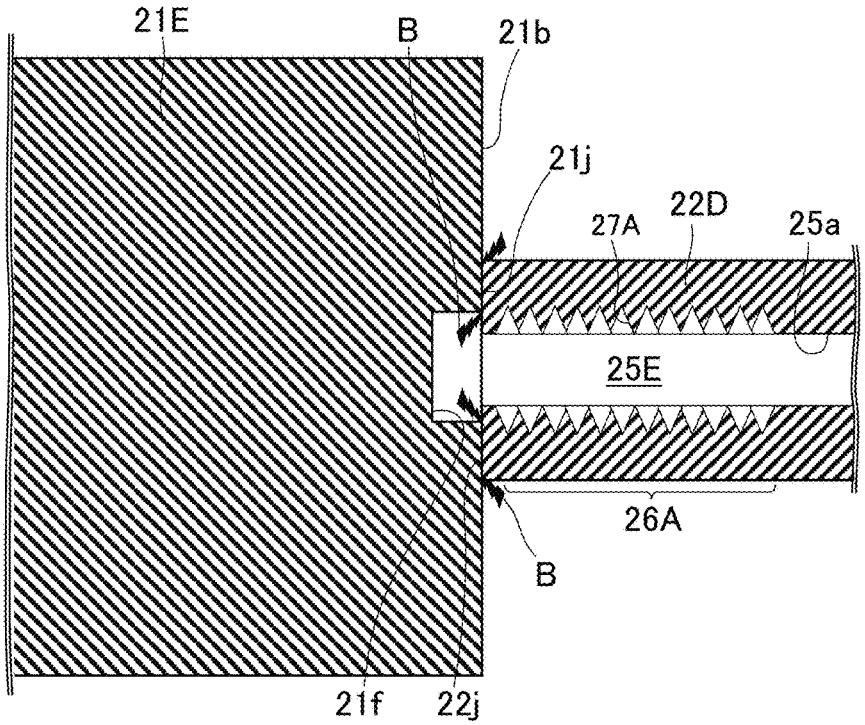
FIG. 14 is an explanatory diagram depicting effects and advantages of the screw compressor according to the modification example of the fourth embodiment.

Next, effects and advantages of the screw rotor in the screw compressor according to the modification example of the fourth embodiment are explained by using FIG. 13 and FIG. 14, in comparison with a screw rotor according to a comparative example. FIG. 13 is an explanatory diagram depicting a state obtained after a discharge-side shaft section in the screw rotor according to the example for comparison with the screw rotor of the screw compressor according to the modification example of the fourth embodiment is joined. FIG. 14 is an explanatory diagram depicting effects and advantages of the screw compressor according to the modification example of the fourth embodiment. Note that those denoted by the same reference characters in FIG. 13 and FIG. 14 as the reference characters depicted in FIG. 1 to FIG. 12 are similar portions, and accordingly, detailed explanations thereof are omitted.

Friction welding is to soften the base materials by frictional heat that is generated by rubbing the base materials against each other at high speed and further apply a pressure so as to join base materials in their solid phase states by plastically deforming both. In friction welding, a material that is a factor inhibiting joining, such as an oxidized film, is pushed as a burr to the outside from joined surfaces of both base materials.

A screw rotor 102 according to the comparative example is configured by joining a discharge-side shaft section 122 having a cooling flow path 125 with a planar discharge-side end face 121*b* without a recess on a rotor lobe section 121 by friction welding. That is, while the joined surface of the rotor lobe section 121 according to the comparative example is a flat surface, the joined surface of the discharge-side shaft section 122 having the cooling flow path 125 is a circular flat surface. Because of this, when the rotor lobe section 121 and the discharge-side shaft section 122 are joined by friction welding, a burr B is generated near an outer circumferential surface of the discharge-side shaft section 122 and a wall surface 125*a* of the cooling flow path 125. There is a concern that, if the burr B generated near the wall surface 125*a* of the cooling flow path 125 covers the wall surface 125*a* of the cooling flow path 125, the area size of heat transfer between the wall surface 125*a* of the cooling flow path 125 and the coolant decreases.

In contrast, in the present embodiment, as depicted in FIG. 12, the recess 21*f* is provided at the joined portion on the discharge-side end face 21*b* of the rotor lobe section 21E, and the diameter Dl of the recess 21*f* is set smaller than the outer diameter ds of the discharge-side shaft section 22D but greater than the diameter dp of the cooling flow path 25E of the discharge-side shaft section 22D. This causes the burr B, which is pushed out of joined surfaces 21*j* and 22*j* of the rotor lobe section 21E and the discharge-side shaft section 22D when the rotor lobe section 21E and the discharge-side shaft section 22D are joined by friction welding, to be generated not on the side of the cooling flow path 25E of the discharge-side shaft section 22D but on the side of the recess 21*f* of the rotor lobe section 21E. Because of this, a decrease of the area size of heat transfer between the wall surface 25*a* of the cooling flow path 25E and the coolant, which decrease might be caused by the burr B covering the wall surface 25*a* having the groove structure 26A in the cooling flow path 25E, can be prevented.

In the modification example of the fourth embodiment mentioned above, as in the fourth embodiment, the groove structure 26A is provided on the wall surface 25*a* of the cooling flow path 25E, and the nozzle 15 (not depicted) which is a stationary member is arranged inside the cooling flow path 25E in such a manner as to overlap at least a part of the groove structure 26A. This enhances the heat transfer coefficient on the wall surface 25*a* of the cooling flow path 25E having the groove structure 26A, thereby improving the capability to cool the discharge-side shaft section 22D of the male rotor 2E (screw rotor). That is, the capability to cool the discharge-side shaft section 22D of the male rotor 2E (screw rotor) can be enhanced with a simple structure.

In addition, in the present modification example, the rotor lobe section 21E has the recess 21*f* at a portion to be joined with the discharge-side shaft section 22D. The diameter of the recess 21*f* is set smaller than the outer diameter of the discharge-side shaft section 22D but greater than the diameter of the cooling flow path 25E.

According to this configuration, the burr B that is pushed out of the joined surfaces 21*j* and 22*j* when the rotor lobe section 21E and the discharge-side shaft section 22D are joined by friction welding is generated not inside the cooling flow path 25E but in the recess 21*f* of the rotor lobe section 21E, and thus the wall surface 25*a* of the cooling flow path 25E can be prevented from being covered with the burr B generated by friction welding. Accordingly, the capability to cool the discharge-side shaft section 22D of the male rotor 2E (screw rotor) can be prevented from being impaired by friction welding.

Other Embodiments

Note that the present invention is not limited to the embodiments mentioned above and includes various modification examples. The embodiments described above are explained in detail for explaining the present invention in an easy-to-understand manner, and the present invention is not necessarily limited to those including all the constituent elements explained. That is, it is possible to replace some of constituent elements of an embodiment with constituent elements of another embodiment, and it is also possible to add constituent elements of an embodiment to the constituent elements of another embodiment. In addition, some of the constituent elements of each embodiment can also have other constituent elements additionally, be deleted, or be replaced.

Whereas the oil-free screw compressor 1 is taken and explained as an example in the first to fourth embodiments and modification examples thereof mentioned above, the present invention can be applied also to a liquid-flooded-type screw compressor that supplies a liquid such as oil or water to the working chambers C.

In addition, the screw compressor 1 of a twin-screw type including the pair of screw rotors (the male rotor and the female rotor 3) is taken and explained as an example in the embodiments mentioned above. However, the present invention can be applied also to a screw compressor of a multi-screw type including three or more screw rotors. In addition, the present invention can be applied also to a screw compressor of a single-screw type including one screw rotor and a pair of gate rotors.

In addition, the configuration examples in which the groove structure 26 or 26A is provided only on the wall surface 25*a* of the cooling flow path 25, 25C, or 25E of the male rotor 2 are depicted in the embodiments mentioned above. However, a configuration in which a groove structure is provided only on a wall surface 35*a* of the cooling flow path 35 of the female rotor 3 or a configuration in which groove structures are provided on both the wall surface 25*a* of the cooling flow path 25, 25C, or 25E of the male rotor 2 and the wall surface 35*a* of the cooling flow path 35 of the female rotor 3 is also possible.

In addition, the configuration examples in which the groove structure 26 or 26A is provided over the entire region, between the position of the discharge-side end face 21*b* and the mounting position of the discharge-side bearing 6, on the wall surface 25*a* of the cooling flow path 25 of the male rotor 2 are depicted in the embodiments mentioned above. However, a configuration in which a groove structure is provided at a portion of the region, between the position of the discharge-side end face 21*b* and the mounting position of the discharge-side bearing 6, on the wall surface 25*a* of the cooling flow path 25 is also possible. In addition, a configuration in which a groove structure is provided extending beyond the region on the wall surface 25*a* of the cooling flow path 25 between the position of the discharge-side end face 21*b* and the mounting position of the discharge-side bearing 6 is also possible.

DESCRIPTION OF REFERENCE CHARACTERS

1: Screw compressor
2, 2A, 2B, 2C, 2D, 2E: Male rotor (screw rotor)
3: Female rotor (screw rotor)
6, 7: Discharge-side bearing
15: Nozzle
21, 21E: Rotor lobe section
21*a*: Lobe
21*b*: Discharge-side end face
21*f*: Recess
22, 22D: Discharge-side shaft section
25, 25C, 25E: Cooling flow path
25*a*: Wall surface
26, 26A: Groove structure
27: Circular groove
27A: Helical groove
28: Sealing member
31: Rotor lobe section
31*a*: Lobe
32: Discharge-side shaft section
35: Cooling flow path
35*a*: Wall surface

The invention claimed is:

1. A screw compressor comprising:

a screw rotor including a rotor lobe section that has a twisted lobe and also has a discharge-side end face on one side in an axial direction, and a discharge-side shaft section provided on the one side in the axial direction at the rotor lobe section; and a discharge-side bearing mounted on the discharge-side shaft section, wherein the screw rotor has a cooling flow path extending in the axial direction at least inside the discharge-side shaft section, a groove structure is provided at at least a part of a region on a wall surface of the cooling flow path, the region being between a position of the discharge-side end face in the axial direction and a mounting position of the discharge-side bearing, the groove structure includes grooves or a groove that has a lengthwise component in a circumferential direction of the screw rotor and that is spaced apart in the axial direction, a nozzle that is a stationary member for supplying a coolant is arranged inside the cooling flow path with a gap between the nozzle and the wall surface,-and the nozzle is arranged in such a manner as to overlap at least a part of the groove structure in the axial direction, and the nozzle includes at least one side hole for supplying the coolant, the at least one side hole opening in a radial direction in the region between the position of the discharge-side end face and the mounting position of the discharge-side bearing.

2. The screw compressor according to claim 1, wherein the groove structure includes a plurality of circular grooves arranged at intervals in the axial direction.

3. The screw compressor according to claim 1, wherein the groove structure includes a helical groove.

4. The screw compressor according to claim 1, wherein the cooling flow path is formed by a through-hole that penetrates the screw rotor in the axial direction, and an opening of the cooling flow path in the axial direction is provided with a sealing member that prevents entry of a fluid other than the coolant to the cooling flow path.

5. The screw compressor according to claim 1, wherein the cooling flow path is formed by a bottomed hole that has an opening on a side of a distal end of the discharge-side shaft section.

6. The screw compressor according to claim 1, wherein the discharge-side shaft section is formed as a member separate from the rotor lobe section, and the cooling flow path penetrates the discharge-side shaft section.

7. The screw compressor according to claim 6, wherein the rotor lobe section has a recess at a portion to be joined with the discharge-side shaft section, and a diameter of the recess is set smaller than an outer diameter of the discharge-side shaft section but greater than a diameter of the cooling flow path.

8. The screw compressor according to claim 1, wherein the groove structure is provided over the entire region between the position of the discharge-side end face and the mounting position of the discharge-side bearing.

* * * * *